US011871800B2

(12) United States Patent
Solano et al.

(10) Patent No.: US 11,871,800 B2
(45) **Date of Patent: *Jan. 16, 2024**

(54) MULTI-TUMMY LAYER BODY SHAPER WITH VARIABLE DENSITY MESH

(71) Applicant: Maddox Holdings, Inc., Holtsville, NY (US)

(72) Inventors: Yajaira Solano, Patchogue, NY (US); Bruce Moncada, Patchogue, NY (US)

(73) Assignee: Maddox Holdings, Inc., Fort Lauderdale, FL (US)

( * ) Notice: Subject to any disclaimer, the term of this patent is extended or adjusted under 35 U.S.C. 154(b) by 189 days.

This patent is subject to a terminal disclaimer.

(21) Appl. No.: 16/876,747

(22) Filed: May 18, 2020

(65) Prior Publication Data

US 2021/0186123 A1 Jun. 24, 2021

Related U.S. Application Data

(63) Continuation-in-part of application No. 16/724,000, filed on Dec. 20, 2019, now Pat. No. 11,457,671.

(51) Int. Cl.
*A41C 1/08* (2006.01)
*A41B 9/00* (2006.01)
(Continued)

(52) U.S. Cl.
CPC ..... *A41C 1/08* (2013.01); *A41B 9/00* (2013.01); *A41C 1/06* (2013.01); *D04B 1/24* (2013.01); *A41B 2400/38* (2013.01)

(58) Field of Classification Search
None
See application file for complete search history.

(56) References Cited

U.S. PATENT DOCUMENTS 2,424,056 A 7/1947 Ruth
2,629,996 A 3/1953 Hamilton
(Continued)

FOREIGN PATENT DOCUMENTS

EM 20203290.0-1017 4/2021
EP 1136001 A1 9/2001
(Continued)

OTHER PUBLICATIONS

English Translation of 1st Office Action issued in the Dominican Republic dated Jun. 1, 2023 for related App. No. P2020-0251.

*Primary Examiner* — Jocelyn Bravo
(74) *Attorney, Agent, or Firm* — Alfred M. Walker

(57) ABSTRACT

A woman's multi-tummy layer body shaper with variable density mesh undergarment which includes breast pockets and buttocks pockets made of flexible lace patterned mesh, includes a top region and a multi-layer compression abdominal region below the breasts. For women, the garment has a crotch area made of two overlapping pieces of fabric, leaving a gap to use in the restroom. The garment also includes a pair of arm coverings which cover at least a shoulder clavicle area of the wearer, with optional short sleeves, half sleeves or full sleeves, and optional leg coverings of variable lengths. The body shaper undergarment also includes an abdominal compression area, which includes an inner skin contact compressive breathable, sweat-porous layer therethrough, a middle textured, breathable, sweat-porous compressive layer and an outer breathable, sweat-porous, compressive layer. An optional front openable corset may be provided to the body shaper undergarment.

8 Claims, 20 Drawing Sheets

(51) Int. Cl.
*A41C 1/06* (2006.01)
*D04B 1/24* (2006.01)

(56) References Cited

U.S. PATENT DOCUMENTS

| | | | | |
|---|---|---|---|---|
| 3,245,409 | A | 4/1966 | Martin | |
| 3,338,071 | A | 8/1967 | Pons et al. | |
| 3,362,029 | A | 1/1968 | Comerma | |
| 3,375,829 | A | 4/1968 | W. E. et al. | |
| 3,413,824 | A | 12/1968 | Kuney | |
| 3,824,812 | A | 7/1974 | Matthews et al. | |
| 3,909,851 | A | 10/1975 | Garrou et al. | |
| 4,267,607 | A | 5/1981 | Tino | |
| 5,054,129 | A | 10/1991 | Baehr | |
| 5,097,537 | A | 3/1992 | Ewing | |
| 5,746,068 | A | 5/1998 | Popa et al. | |
| 5,787,732 | A | 8/1998 | Perron et al. | |
| 5,888,118 | A | 3/1999 | Kishi | |
| 6,276,176 | B1 | 8/2001 | Blakely | |
| 6,298,486 | B1 * | 10/2001 | Huang | A41C 1/003 2/408 |
| 6,463,765 | B2 | 10/2002 | Blakely | |
| 7,024,892 | B2 | 4/2006 | Blakely | |
| 7,081,036 | B1 | 7/2006 | Howard et al. | |
| 7,260,961 | B1 * | 8/2007 | Kennedy | D04B 1/243 66/171 |
| 8,550,088 | B1 | 10/2013 | Booher | |
| 9,474,308 | B2 | 10/2016 | Cronan | |
| 9,730,476 | B1 | 8/2017 | Mahar | |
| 9,867,400 | B2 | 1/2018 | Solano et al. | |
| 9,955,739 | B2 | 5/2018 | Melarti et al. | |
| 10,058,131 | B2 | 8/2018 | Solano et al. | |
| 10,463,530 | B2 | 11/2019 | Booher | |
| 10,701,985 | B2 | 7/2020 | Cano | |
| 11,627,764 | B1 * | 4/2023 | Kaylin | A41C 3/0021 450/55 |
| 2002/0000684 | A1 * | 1/2002 | Nakanishi | A41C 5/005 264/292 |
| 2002/0002023 | A1 * | 1/2002 | Nakanishi | A41C 3/142 450/66 |
| 2002/0007507 | A1 | 1/2002 | Duran | |
| 2003/0019014 | A1 | 1/2003 | Duran | |
| 2003/0110551 | A1 | 6/2003 | Lazarian | |
| 2004/0006811 | A1 * | 1/2004 | Mckenzie | A41B 11/14 2/240 |
| 2004/0111781 | A1 * | 6/2004 | Miyake | D04B 21/207 2/69 |
| 2007/0163026 | A1 * | 7/2007 | Perry | A41F 15/02 2/69 |
| 2007/0249265 | A1 * | 10/2007 | Delgado-Mecinas | A41B 9/00 450/156 |
| 2010/0005560 | A1 | 1/2010 | Albizre | |
| 2010/0235970 | A1 | 9/2010 | Rad | |
| 2011/0207382 | A1 * | 8/2011 | Kent | A41C 1/003 450/11 |
| 2011/0289648 | A1 | 12/2011 | Burke | |
| 2012/0036616 | A1 | 2/2012 | Miyasaka | |
| 2012/0129425 | A1 | 5/2012 | Bevans | |
| 2014/0057530 | A1 | 2/2014 | Mazourik et al. | |
| 2014/0273734 | A1 * | 9/2014 | Gordon | A41C 1/06 450/7 |
| 2016/0150832 | A1 * | 6/2016 | Solano | A41B 11/14 450/95 |
| 2017/0036066 | A1 * | 2/2017 | Chahine | A41D 1/002 |
| 2017/0318864 | A1 | 11/2017 | Carroll et al. | |
| 2019/0075853 | A1 | 3/2019 | Altmann et al. | |

FOREIGN PATENT DOCUMENTS

| | | | |
|---|---|---|---|
| EP | 210416 | B1 | 4/2016 |
| EP | 3838036 | B1 | 7/2022 |
| GB | 1514100 | A | 6/1978 |
| GB | 1514100 | A1 | 6/1978 |
| GB | 2488183 | A | 8/2012 |
| GB | 2016753.2 | | 4/2021 |
| MX | 3838036 | B1 | 8/2023 |
| WO | 2012109474 | A1 | 8/2012 |
| WO | WO2012/109474 | A1 | 8/2012 |
| WO | PCT/US2014069344 | A | 3/2015 |
| WO | WO2015089071 | A1 | 6/2015 |

* cited by examiner

MULTI-TUMMY LAYER BODY SHAPER WITH VARIABLE DENSITY MESH

RELATED APPLICATIONS:

This application is a continuation-in-part of application Ser. No. 16/724,000 filed Dec. 20, 2019 and claims priority in part therefrom under 35 USC § 120.

FIELD OF THE INVENTION

The present invention relates to a body shaper undergarment with flexible, expandable mesh or lace-patterned mesh coverings for the breasts and/or buttocks to allow for enhancement, while the mesh coverings are supported by thicker fabric material on the bottom, and left and right flanks adjacent to the expandable mesh material, where the breasts and/or buttocks are allowed to expand into the breast and/or buttocks pouch areas of the mesh, thereby forming a more desirable look. The mesh regions can also have one or more sub-regions of thicker mesh, or the entire flexible, expandable mesh region can have a single mesh of infinitely variable thicknesses and/or linear densities, expressed in deniers, that gradually change from one boundary side of the expanded mesh region to an opposite boundary side of the expandable mesh region.

BACKGROUND OF THE INVENTION

The conventional types of hosiery/undergarment typically compress, and smooth body portions being designed to create a toned look to the legs and some support to areas controlled by panty hose and girdles. Some prior art of this type includes U.S. Pat. No. 6,463,765 of Blakely, U.S. Pat. No. 4,267,607 of Tino, U.S. Pat. No. 5,097,537 of Ewing, U.S. Pat. No. 5,787,732 of Duran, and US Published Patent Application Number 2004/0006811 of McKenzie.

In contrast to the prior art cited above, prior art U.S. Pat. No. 10,058,131 of Solano and Moncada, assigned to Maddox Holdings Inc, relates to a butt enhancing hosiery/shaper undergarment which uses a combination of members of different materials to actually lift and shape the rear buttocks region. In Solano, et al, '131 patent, the buttocks area of the undergarment is surrounded on the top, sides and bottom of the buttocks area by thicker fabric material than the buttocks regions which are covered in an expandable material or mesh of uniform. Thus, the left and right buttocks are supported by the thicker material on top, bottom, and left and right flanks of the undergarment, separated by a thin G-string area, and each buttocks area is allowed to expand into the buttocks pouch area of the mesh thereby forming a more desirable look. The front of the undergarment has a thicker fabric on the stomach wall portion to compress the stomach area.

The body-shaping garments for both men and women of this invention are for use as underwear or as partially covered active wear. Using one or more layers of stretch fabric panels, body shape is enhanced while activity (as in exercise) is supported through selective compression.

The prior art reveals some garments which have similar objectives. The aforementioned U.S. Pat. of Solano '131 is for a butt enhancing undergarment offering limited compression of certain body regions in a body shaper undergarment.

The body-shaping garment of Melarti, et al., U.S. Pat. No. 9,955,739, describes a woman's garment compressing a portion of the mid-section of a wearer above the waist. This upper part is attached to a lower portion of the garment at a seam. The lower portion may include panties with optional skirt.

The body-shaping intimacy garment described in U.S. Pat. No. 9,474,308 of Cronan is a woman's garment in two layers. The inner layer is stretched over the torso, waist, buttocks, hips and legs. The outer layer is of lower elasticity than the inner layer and is attached to the inner layer only at the bust.

US Patent Application Number 2012/0129425 of Bevans is a woman's shapewear garment in two layers which are attached as a shell and a lining. The garment may be a dress, a jumper, a romper, a top, pants, shorts, or skirt. Compression is obtained by using elastic fabric in all parts of the garment.

U.S. Pat. No. 7,024,892 of Blakely for a woman's two-ply body-smoothing lower-body body shaper undergarment is made by circularly knitting a pair of fabric tubes.

U.S. Pat. No. 5,746,068 of Popa, et al., describes a method of using a circular knitting machine to integrally knit a two-layer lower body garment.

OBJECTS OF THE INVENTION

It is therefore an object of the present invention to provide a body shaper undergarment which is comfortable to wear, and which provides some visual enhancement.

It is also an object of the invention to provide a body shaper undergarment which supports provides lace looking patterns on the breast and/or buttocks covering portions thereof.

It is further object of the present invention to provide a body shaping undergarment without seams.

It is yet another object of the present invention to provide variable density expandable mesh portions of butt and breast enhancing undergarments in general.

The present invention also relates to multi-layer compressive breathable, sweat-porous body shaping garments which have compressive, breathable, strong layers in the abdominal area of the wearer of the body shaper undergarment.

Other objects which become apparent from the following description of the present invention.

SUMMARY OF THE INVENTION

Using materials and methods similar to those used by the inventor in U.S. Pat. No. 10,058,131 of Solano et al for a butt enhancing hosiery/shaper undergarment, an under garment is provided where the buttocks and/or also the breast area, has flexible, expandable, minimally compressive, stretchable mesh regions, preferably flexible mesh lace regions, with or without denser regions at lower portions thereof and/or with or without infinitely variable thicknesses or densities in deniers of mesh covering the buttocks and/or breasts of the wearer. Additionally an optional multi-layer abdominal portion can be provided for exercise, where the abdominal area is covered by a compressive breathable, sweat-porous mesh area, surrounded by one or more compressive porous fabric layers of varying compressive strengths on the interior skin facing layer and/or on the outer layer thereof, to provide a garment that is comfortable to wear even in exercise and which also improves the physical appearance of the wearer.

The multi-layer optional garment help keep the body of the woman in place, including the abdomen, breasts and buttocks, or any combination thereof. In an alternate embodiment, the abdomen area features the two or more, preferably three layers, as noted aforesaid, with different thickness or density in deniers and porosity on the full abdomen area. As in Solano '131 the bottom and side flank parts of the expandable, flexible mesh, or lace-patterned mesh, lace buttocks and breast areas are supported by thick supportive fabric so they can support the breasts and buttocks with the respective flexible expandable mesh portions, without sagging. However, the buttocks and breast regions may have variable density regions at lower edges thereof, or may comprise an infinitely variable mesh, to maximize retention of the expanded breast and buttocks portions held in place by the expandable, flexible mesh, or lace-patterned mesh, portions. The section supporting the mid abdomen below the breasts can be lighter and less dense than that of the breast and buttocks flank areas , but compressive, to hold the abdomen in place during exercise but which are porous enough to allow sweat to pour therethrough, as compared to prior art weight reducing garments of neoprene and other non-porous uncomfortable sweat retaining materials.

The seamless body shaper undergarment may be manufactured in a conventional manner with conventional knitted materials, such as, for example, NYLON®, LYCRA®, SPANDEX®, silk, cotton, or cellulose derived fabric materials, such as RAYON®, etc. It can also be made of a fabric mix of nylon and elastane, an elastic polyurethane material, in an 84% to 16% ratio, with a thickness of between about 150 to 400 GSM. It is preferably manufactured on a circular hosiery knitting machine using a Jacquard machine, or by warped knitted seamless technique or other seamless knitting process. Rather than using elastic bands, knitted-in welts are knitted in during the knitting process where needed. This enables the garment to be manufactured in one continuous knitting process thereby eliminating a further post-process of attaching elastic bands. Preferably using tubular forms, the warped knitting seamless technique creates body forming garments from the original tubular structures, which are anatomically adaptable in shape, but also can add various arm and leg sub-features to the anatomically shaped tubular garment.

As mentioned in the previous section, the butt-enhancing body shaper undergarment of Applicant's U.S. Pat. No. 10,058,131 of Solano et al uses expandable mesh regions to cover the rear buttocks regions and a thicker fabric in general to cover the stomach wall area to flatten the stomach area. For this invention, however, the stomach wall area is preferably partly covered in a breathable, sweat-porous, but compressive porous material layer, to hold the abdomen in place during exercise, while permitting breathable fabric to allow sweat to pour therethrough for comfort and weight loss.

The body shaper undergarment option of the present invention has expandable, flexible mesh areas in one or both of the breasts and/or buttocks regions , which are surrounded on the bottom and side flank areas as in Solano et al '131, with supportive fabric having a thickness of a range of deniers of from about 40 deniers to about 200 deniers, However, unlike Solano '131, the lower crescent shaped regions of the expandable, flexible mesh may have thicker densities, either incrementally in two or more lower crescent shaped regions, or in a lower crescent shaped region with infinitely variable densities of the expandable lower lace mesh portions.

As an option, the expandable, flexible mesh may be provided in aesthetically pleasing patterns, such as lace-patterned mesh.

Expressed another way, as in Solano et al '131, the side and bottom flanks of the breast and buttocks areas have a weight of about 230 to 420 GSM (grams per square meter of fabric material). In this situation, the flank and lower support regions of the abdominal area of the garment made be made of stretchable materials, such as, for example, NYLON®, LYCRA®, SPANDEX®, silk, cotton, or cellulose derived fabric materials, such as RAYON®, etc. Preferably, however, this flank and lower support abdominal area is made of 90% NYLON and 10% LYCRA if provided in a single color, or if multicolored pattern designs are provided, may be made of about 84% polyester and about 16% LYCRA. The expandable flexible lace mesh regions of the buttocks and/or breasts are provided in a range of about 10 deniers to about 50 deniers of the respective breast and buttocks portions of the garment.

An extra wide-open crotch double gusset is preferably provided allowing the user to utilize the restroom without removing the garment. However, in alternate embodiments other closures such as a zipper portion can be provided, or even not provided, where removal of the garment would be required in a rest room.

Therefore, the body shaper undergarment includes at least expandable, flexible mesh regions, preferably with lace shaped patterns, in the breast and/or buttocks portions, with an optional compressive non mesh but porous multi-layer abdominal area below the breasts of the wearer. As also in Solano et al '131, side and bottom flank supportive areas of fabric of the garment are sufficiently thick to provide side support for said the expandable lace mesh breast and/or buttocks regions. But these side and bottom flank regions are assisted by the lower one or more crescent shaped expandable, flexible mesh regions of the mesh materials, the breast and/or buttocks pockets.

Adjustable bra straps may be optionally provided supporting the aforementioned side and bottom flank garment areas, which extend down to at least the crotch of the garment, or optionally to thigh bands of the garment.

While the entire front abdominal area can be provided in a single thickness or density in deniers material, preferably the abdominal area includes respective thin outer and inner breathable compressive layer enveloping a stronger, thicker, compressive but breathable, sweat-porous layer therebetween.

While the mesh abdominal area can include two or more said fabric layers, in the preferred embodiment the garment includes a full abdomen area featuring three different thicknesses or densities in deniers of material placed sequentially in a layered fashion to provide strong abdominal tummy support and to cinch the waist, flatten the abdominal tummy area and smooth the back of the torso. The tummy section fabric also allows sweat through. It is sweat wicking, even in intense exercise.

Preferably the garment is seamless, made in a continuous knitting process. The garment is therefore constructed entirely of knitted materials in which the garment is manufactured in one continuous knitting process thereby eliminating a post-process of attaching elastic bands.

However, in non-preferred embodiments the various parts of the garment can be separately made and attached together to a central hollow body portion by being sewn with threads or glued with strips of glue or other adhesive.

While garment is preferably made to start below the breasts, upper chest and back portions can be provided and/or the garment has an opening for use of a bra.

Additionally, the body shaper undergarment can be provided with the arm coverings, ranging in size, from a minimal tank top with arm openings, short tee shirt length arms, elbow length arms or full-size arms extending to the wrist and hands of the wearer. The arm and shoulder regions are less compressive than the front and back compressive areas, because they have to comfortable and not too tight to avoid restricting blood circulation, with a thickness or density in deniers of about 30 to 200 deniers. Likewise, the body shaper undergarment can be provided with leg coverings, such as shorts length covering the hips and upper thighs, mid-thigh leg coverings, knee high length leg coverings, calf-length Capris-style leg coverings, or full-length leg coverings extending to the ankles of the wearer. Furthermore, the abdominal region can include an optional corset over the multi-layers, which opens up in the front, or the corset can itself can function as the torso portion of the garment and it itself can have one or more inner breathable, sweat-porous, compressive layers.

Additionally, in an optional embodiment side flank areas of the garment are adapted to cover the breasts and/or buttocks of a user. These flank areas may support and surround expandable mesh regions adapted to enclose the breasts and/or buttocks, which optionally are made of lace-patterned mesh fabric. However, as noted above, preferably the breast and buttocks enclosed mesh regions include multiple regions of stretch, such as at least one of the multiple regions being less stretchable. In a further alternate embodiment, the multiple regions include two or more less stretchable regions, preferably arcuately shaped, are provided at the lowest portion of the buttocks mesh regions.

In an alternate embodiment, the upper abdominal, mid waist and lower abdominal areas can be made off a single, integral front portion, wherein the upper abdomen portion, the middle band and the lower abdominal portion are a single, or multiple strong, fabric layers of material designed to flatten the areas and not allow them to expand outward in contrast to the expandable, flexible mesh regions in the breast and/or buttocks regions. By areas it can include the abdominal tummy area, but also side bulging "love handles" of fatty tissue in the side of the hips area and lower lumbar area of the back.

Where the multiple breast and buttocks flexible mesh regions include two more regions, a thickest mesh of the plurality of buttocks enclosed mesh regions is provided in a thickness or density in deniers of a range of deniers of from about 20 deniers to about 100 deniers, wherein further a second mesh of less dense and lighter mesh than the thickest mesh is provided in a thickness or density in deniers of from about 10 deniers to about 80 deniers, and wherein the mesh region being the lightest of the multiple portions is provided in a range of about 10 deniers to about 50 deniers of the garment.

While three mesh portions may be provided, more or less can be added, each with different or similar thicknesses or densities in deniers. Also, while the varying thickness or density in deniers segments can be crescent curved-shape, they could alternatively be a single or full breast or buttocks area, with a single expandable mesh that is infinitely variable in thickness or density in deniers from one boundary to another boundary.

In the aforementioned mesh portions with variable expandable stretchability regions, in an alternate embodiment, the expandable mesh used in either the breasts and/or buttocks has variable density or stretchability so that it is heavier (less stretch) on the bottom area to more closely approach the ideal amount of stretch for the local load. A plurality of separate density areas of mesh, such as, for example, three sub-regions, are used from top to bottom of a mesh region. It is important that these sub-regions are seam free to insure a smooth comfortable fit with "no visually discernable undergarment lines". Another alternative is to have a density that is continuously and/or infinitely variable, getting heavier as the bottom of the mesh region is approached. It is noted that these variable density expandable mesh regions are used on the breast and/or buttocks regions of the body shaper undergarment. In this embodiment for expandable mesh portions of any body shaper/undergarment, for a woman, this extra option for the breasts and buttocks areas features the aforementioned plurality of different thicknesses or densities in deniers on buttocks pockets throughout the mesh. The reason why the multiple different, seamless, blended mesh buttocks' sub-regions areas are provided (such as, for example, three sub-regions), is because if the wearer already has large breasts or buttocks, there can be an undesirable compression line or a mark that can be visible under thigh of thin clothes. This multi-part expandable mesh region with variable blended thicknesses or densities in deniers solves this issue by giving the sides and bottom part of breasts and/or buttocks mesh more control with one or more regions of thicker mesh, with or without a flexible mesh lace pattern.

This alternate embodiment for breasts and/or buttocks enclosing regions having multiple sub-regions of stretch for gentle support and shape enhancement, can be used with any one piece undergarment covering at least an upper and a lower region of a front abdominal area, a rear back area and a pair of side flank regions on each side of said body shaper undergarment, connecting said front abdominal to said rear back area, where the under garment further includes a rear buttocks portion. The buttocks portion is a pair of expandable mesh regions separated by a think connector, such as an integral G-string connection or other seamed connection, passing closely between left and right buttocks of the wearer.

The expandable breasts and/or buttocks mesh regions are supported by stronger, denser side flank support regions adjacent to the upper and lower regions supporting the buttocks regions from the sides and below, as described in Solano et al '131 for buttocks regions, whereby the pair of buttocks mesh regions are further pushed outward without compression, as are the breasts regions, not described in Solano et al '131. These breasts and buttocks regions are fully covered by expandable mesh made from garment material thinner and less compressive than the respective garment material making up a remainder of the body shaper undergarment, allowing the breasts and/or buttocks regions to be pushed upward and outward, without compression, during wearing of the body shaper undergarment of the wearer.

The multiple regions of stretch, with lower portions of the at least one mesh regions being less stretchable are at the lower regions of the breasts and/or buttocks mesh regions, to provide further support at the lower portion of the breasts and/or buttocks with a thicker, more supportive mesh material.

Using breathable, sweat-porous knit fabrics with two or preferably, three, or more multilayers primarily in the abdomen area below the breasts, these garments thereby avoid uncomfortable compression of the chest area and they do not restrict any clavicle, arm or shoulder movements during athletic and/or dance exercise. Compressing the abdominal area has an aesthetic component to smooth and hold flab in as well as a physiological component to preventing sagging skin when some body weight is lost during exercise while not restricting breathing.

For women, one version of the body shaper undergarment is a body suit (similar to a one-piece bathing suit) with a triple layer abdominal area. The first outer layer is the outer portion of the whole garment itself made up of breathable, sweat-porous, but firm, compressive layer, while the second middle layer is a compressive mesh layer in the abdominal area, capable of being compressive and also being able to allow sweat to soak therethrough, so that the garment is "breathable", unlike compressive non-breathable neoprene type non-porous materials. The third inner skin connecting layer is also a breathable, sweat-porous, but also thin, compressive layer. The rear back portions of the garment can be a single layer, a double layer or all three. The parts can be tube formed, but the multilayers are glued, sewn or zippered in place.

For the woman's body suit, the outer layer of the entire garment is preferably made of about 90% nylon and 10% LYCRA® knit, but if there are multi-colored patterns, (stripes, leopard skin, etc.) it will be instead knitted in a knit of about 84% polyester and about 16% LYCRA® because they hold multiple colors better than the nylon/LYCRA® composition. The range of weight for the outer layer is about 100 to 250 grams per square meter (GSM), preferably about 180 GSM. Alternatively, the woman's body suit can be made of a fabric material of a mix of nylon and an elastic polyurethane material, such as elastane.

In the body suit, the innermost breathable, sweat-porous layer, of the multilayers, touching the skin has a weight of about 150 to 400 grams per square meter (GSM), preferably about 330 GSM. This area, starting below the breast area is made of a knit of about 65% nylon and about 35% LYCRA®. The middle compressive layer of the multiple layers is a compressive, porous mesh fabric. Latex is to be avoided however, since it is known to harbor bacteria and is allergenic to some people. The multiple layers are strongly compressive, but highly breathable and allow sweat therethrough to the outer layer. It has a weight of preferably about 230 to 250 GSM; instead of the nylon/LYCRA® composition of the other layers, it is about 92% polyester (i.e., a polyamide) and about 8% nylon. The rear back portion of the garment can be three layers, like the front portion (abdominal wrapping around the back) or it can be two-layered with the outer layer of about 180 GSM and an inner layer of about 330 GSM.

The layers can also be made of a fabric mix of nylon and elastane, an elastic polyurethane material, in an 84% to 16% ratio, with a thickness of between about 150 to 400 GSM. If the rear back portion is one layer it will be more compressible at a weight of about 330 GSM. Other women's garments of this invention are described in the detailed description.

There is another metric which relates hole size to amount of stretch of the strong, but breathable, sweat-porous fabric materials. The materials have a wicking function which is related to fluid dynamics. When the hole dimensions are small, the fibers may be coated or uncoated (hydrophilic or hydrophobic).

A woman's exercise body shaping romper garment includes a top region of knitted fabric, and a three-layer compression abdominal region below breasts of a wearer comprising a mixture of polyester and LYCRA® knitted fabric, and preferably having a single layer knitted fabric back region below which is a compression region adjacent a crotch of the garment. The compression sweat porous abdominal region includes an inner skin contact compressive layer capable of emitting body sweat therethrough, a middle compressive layer and an outer sweat porous compressive layer.

Preferably, the exercise body shaping romper garment includes layers comprised of about 84% polyester and 16% LYCRA®, or 84% nylon and 16% elastane, an elastic polyurethane material, with a thickness of between about 150 to 400 GSM.

The present invention for undergarments for women with expandable buttocks and breasts portions includes wearable copper fabrics, mixed with elastane, nylon, spandex and/or any flexible fabric or thread to make it more flexible and wearable. The wearable copper fabrics are a combination of copper or silver-plated yarn which is knitted or woven with various non-conductive yarns. While any copper-based fabrics may be used, preferably the garment's copper fabrics are derived from the Silverell® line of fabrics, which are used for anti-microbial, fungicidal, RF shielding and/or thermal therapeutic applications in the outerwear garments.

In general, the breathable, sweat-porous body shaper garment of a woman's exercise shapewear garment includes an integral top, abdominal compression area, and skirt/shorts/pants of knitted fabric; and an abdominal compression area below the breasts of the wearer including an inner skin contact compressive, breathable, sweat-porous layer, a strongest middle compressive layer and an outer compressive layer.

BRIEF DESCRIPTION OF THE DRAWINGS

The present invention can best be understood in connection with the accompanying drawings. It is noted that the invention is not limited to the precise embodiments shown in drawings, in which.

It is further noted that the various region areas of the body shaper undergarment are shown with various cross hatchings and line configurations, which like areas bear the same cross hatchings and/or line configurations.

DETAILED DESCRIPTIONOF THE INVENTION

Figure 1:
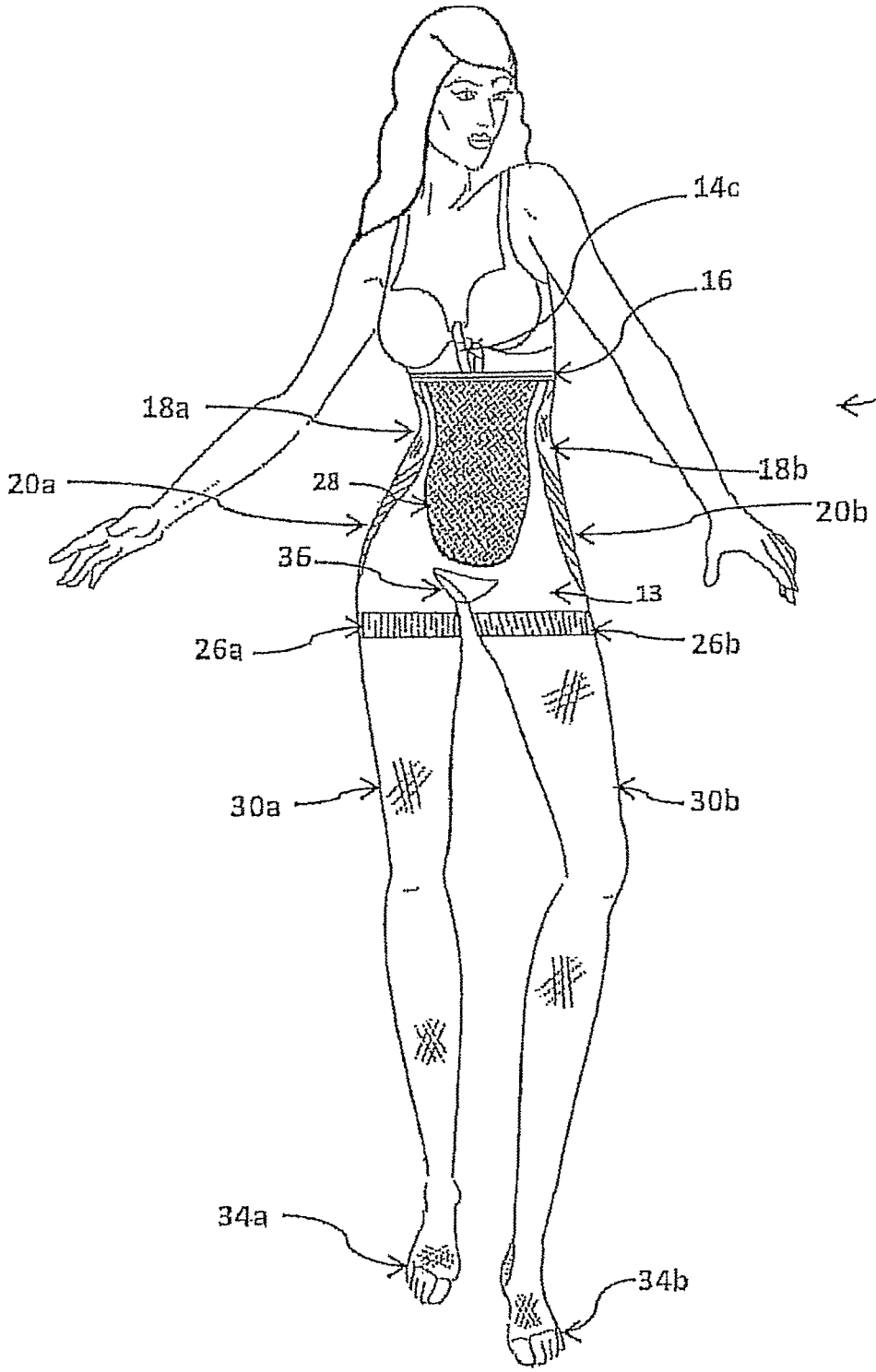
FIG. 1 illustrates a front perspective view of a women's body shaper undergarment of a previous prior art invention.
Figure 2:
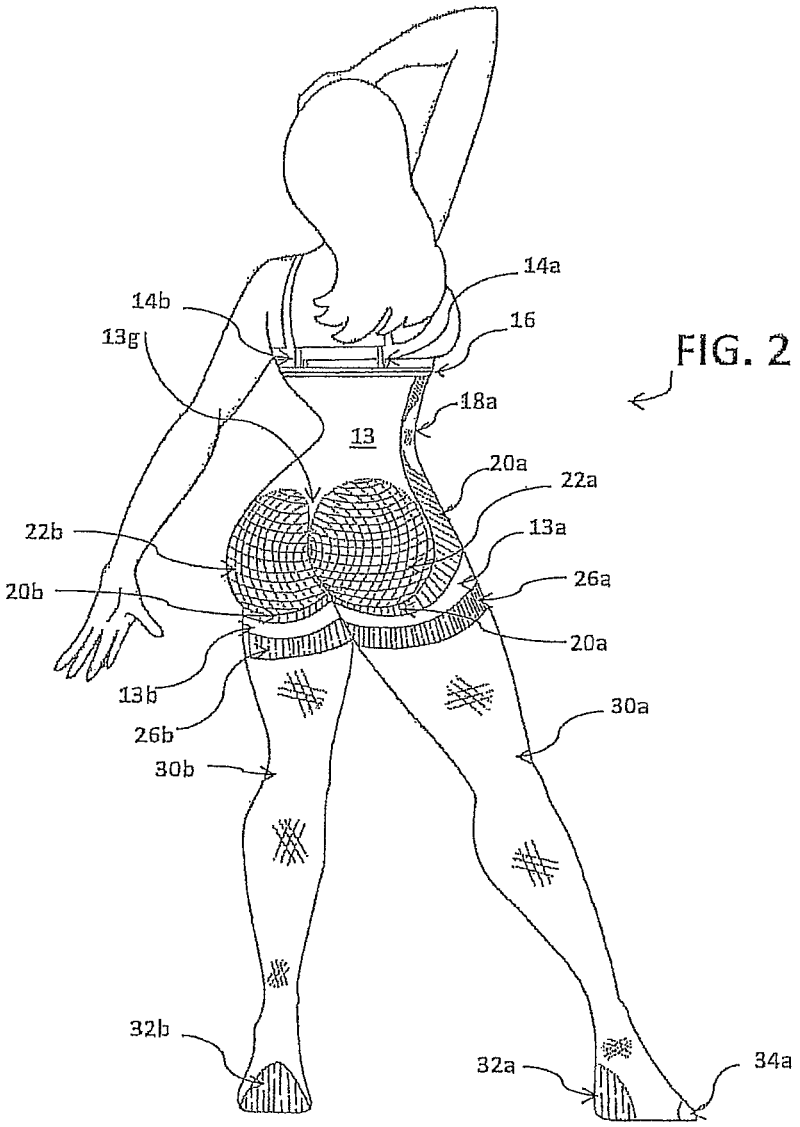
FIG. 2 illustrates a rear perspective view of the same women's body shaper undergarment of FIG. 1 from the previous prior art invention.

FIGS. 1 and 2 are prior art drawings illustrating the front and the back respectively of a body shaper undergarment for butt enhancement. In FIG. 2, expandable mesh regions marked with item labels "B" and "C" are expandable pouches which allow the buttocks to expand into them as supported by less stretchable surrounding regions to form a more desirable look. FIG. 1 of the same prior art shows a thick fabric region over the stomach wall marked as item label "A" which helps to compress the stomach flat.

Figure 3:
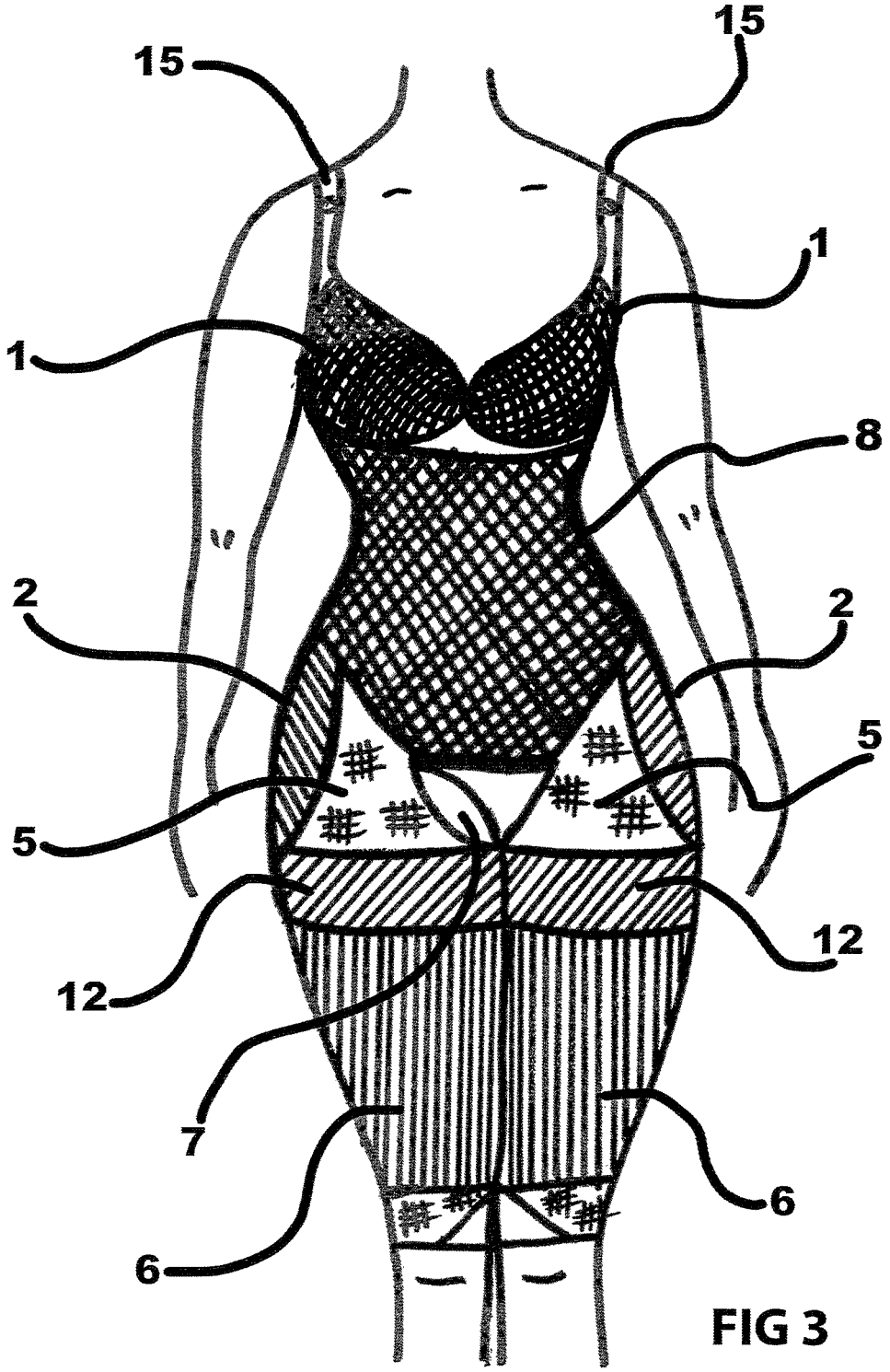
FIG. 3 illustrates a front perspective view of the women's body shaper undergarment of the present invention.
Figure 4:
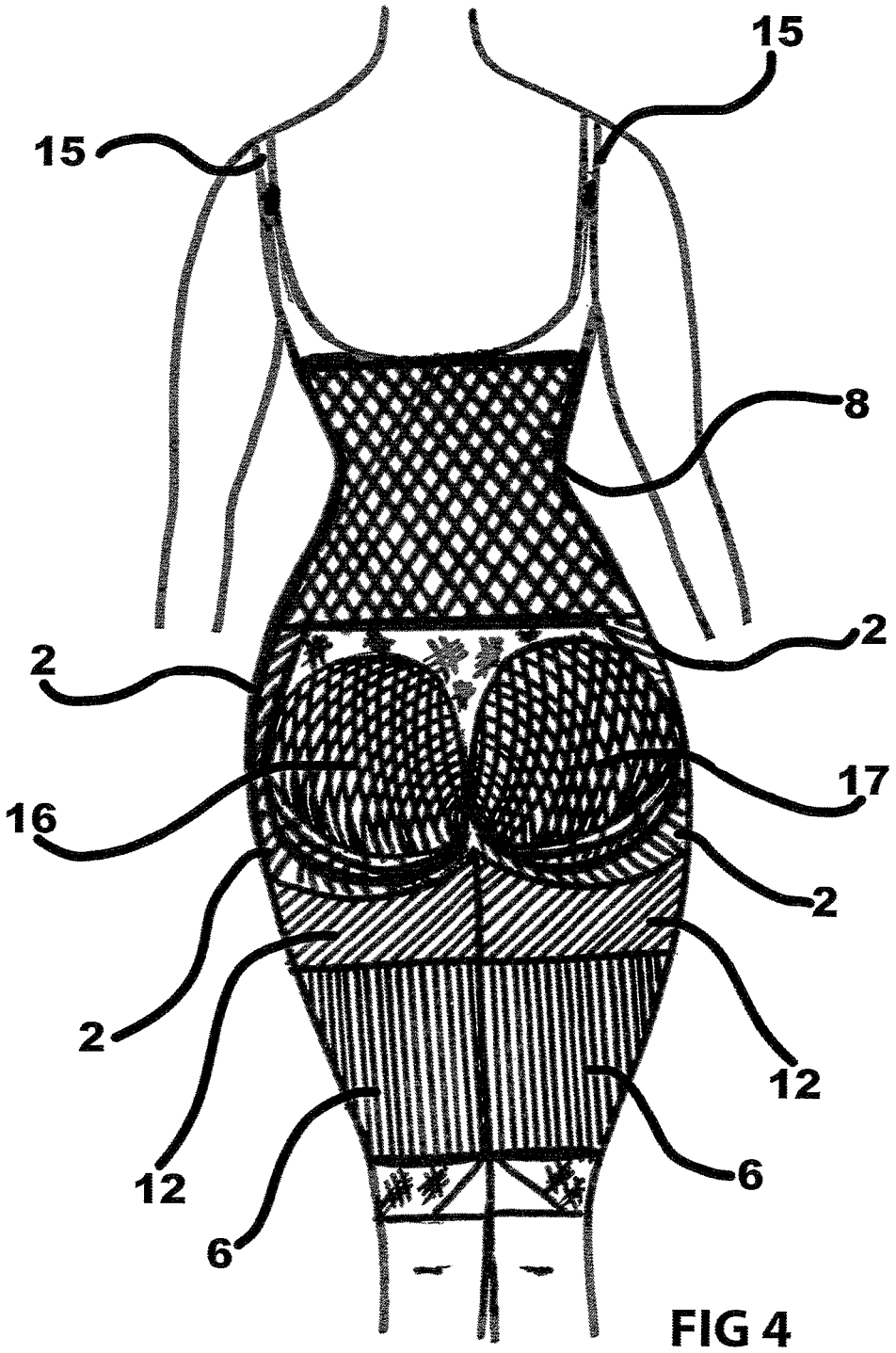
FIG. 4 illustrates a rear perspective view of the woman's body shaper undergarment of the present invention.

FIGS. 3 and 4 are front and rear perspective views of a woman's body shaper undergarment of this invention as worn by a user. Although specific body shaper undergarments may vary in terms of materials and design, the functional aspects are well illustrated by the elements of FIG. 3. Expandable mesh regions 1 are provided in the breast regions which expand outward. Abdominal torso region 8 is denser and more compressive than the stretchable mesh regions 1 covering the breasts. The area around the crotch 5 includes structural sections of thick support material. The side and bottom flank areas 2 are of the thickest fabric which continues to the back as illustrated in FIG. 4, and in the front view of FIG. 3 and the back view of FIG. 4 there are shown upper thigh bands 12, which are less dense than flank regions 2. Mid-thigh bands 6 may have knitted-in welts. Item 7 is a wide-open crotch double gusset. Two bra straps with adjusters 15 support the body shaper undergarment foundation (i.e., front, back and side flanks). The mesh areas 16 and 17 on the right buttocks and left buttocks are shown FIG. 4 as being supported at the edge by the fabric of dense side and bottom flank areas 2.

Figure 5:
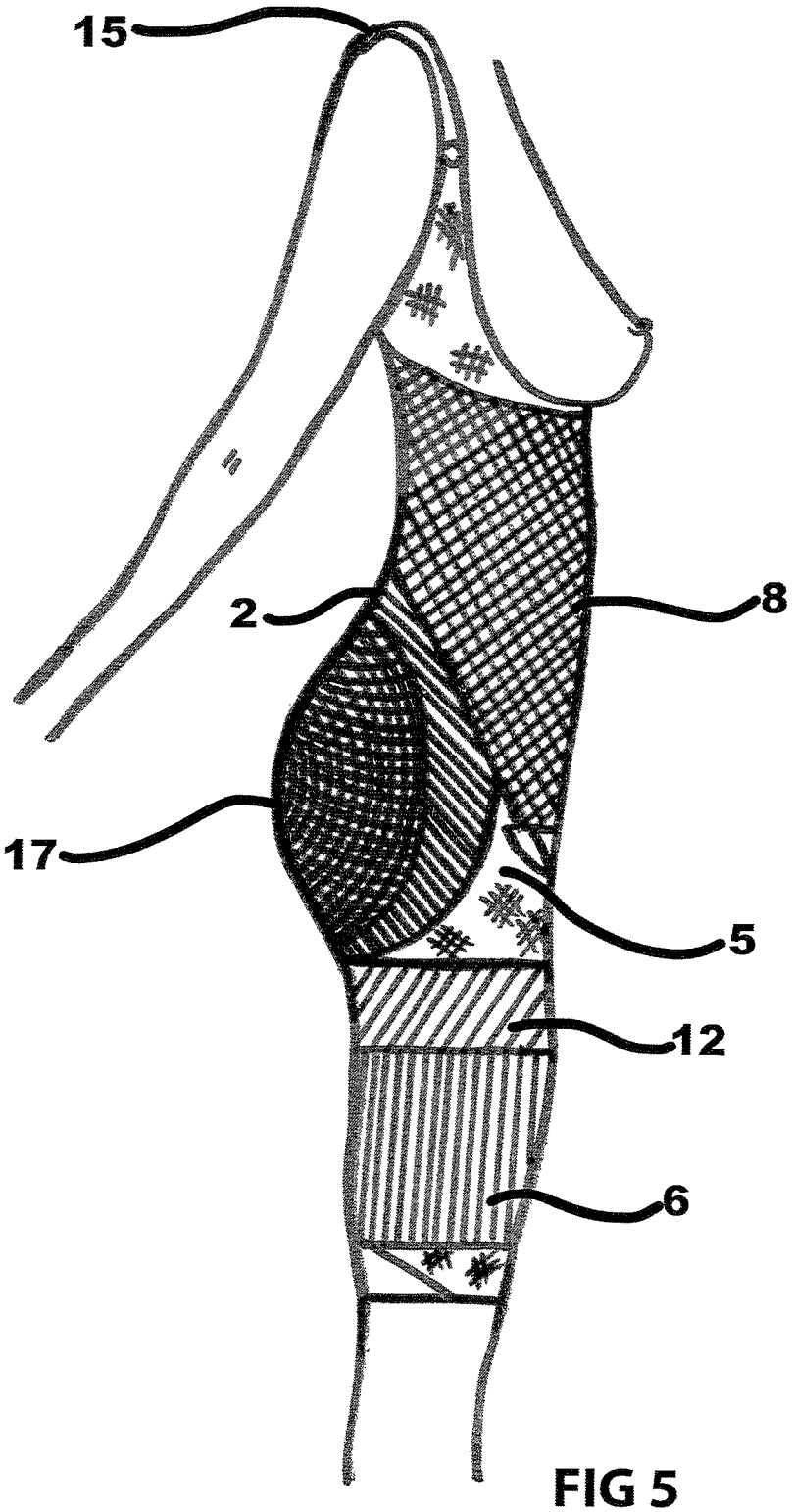
FIG. 5 illustrates a left-side elevation view of the woman's body shaper undergarment of the present invention, showing the breasts being uncovered.

FIG. 5 is a right-side perspective view showing the items described in FIGS. 3 and 4 from the side where sections such as the shape of the side and buttocks flanks 2 are more clearly visible, but wherein the expandable breast mesh regions 1 are shown removed, but revealing the exposed breasts.

Figure 6:
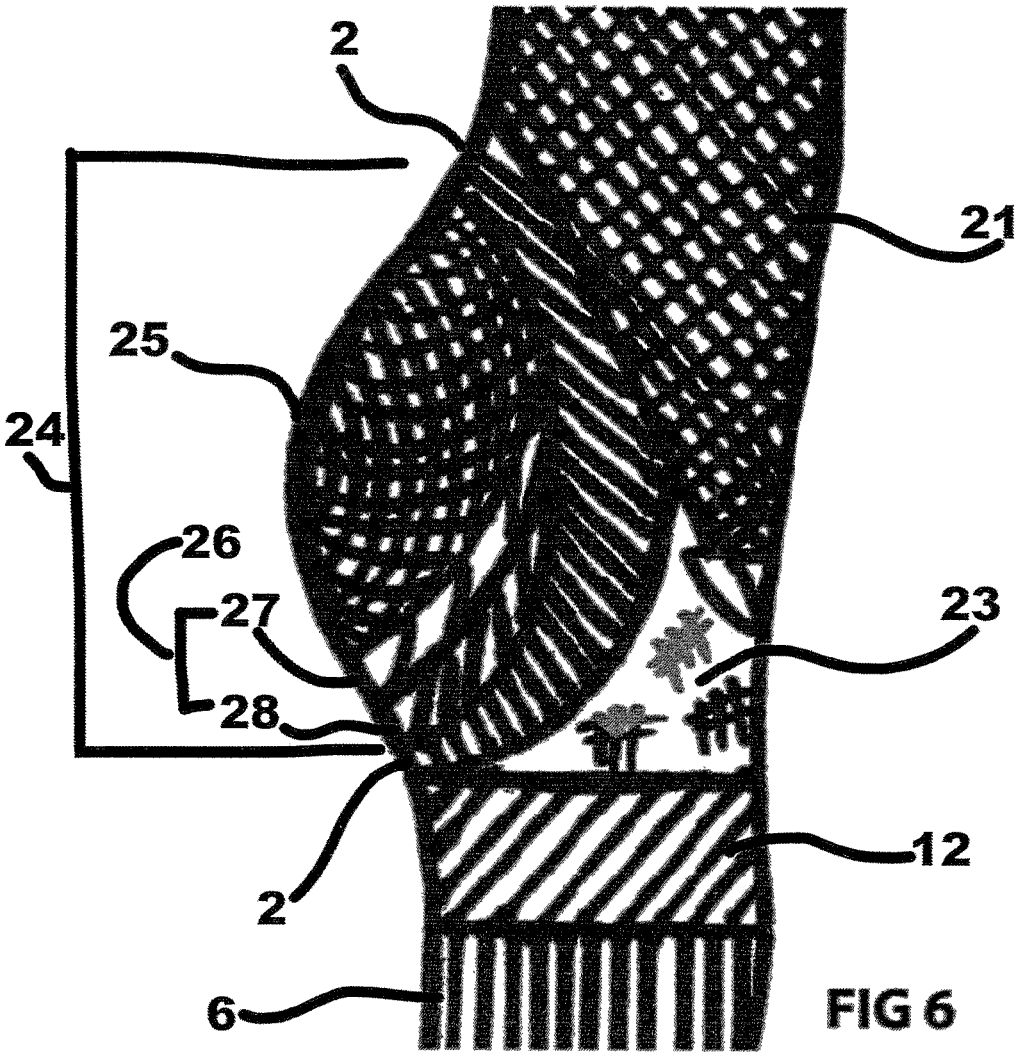
FIG. 6 is a left-side perspective detail of an alternate embodiment of the right buttocks covering provided in mesh, illustrating two bands of higher density mesh at the bottom area.
Figure 7:
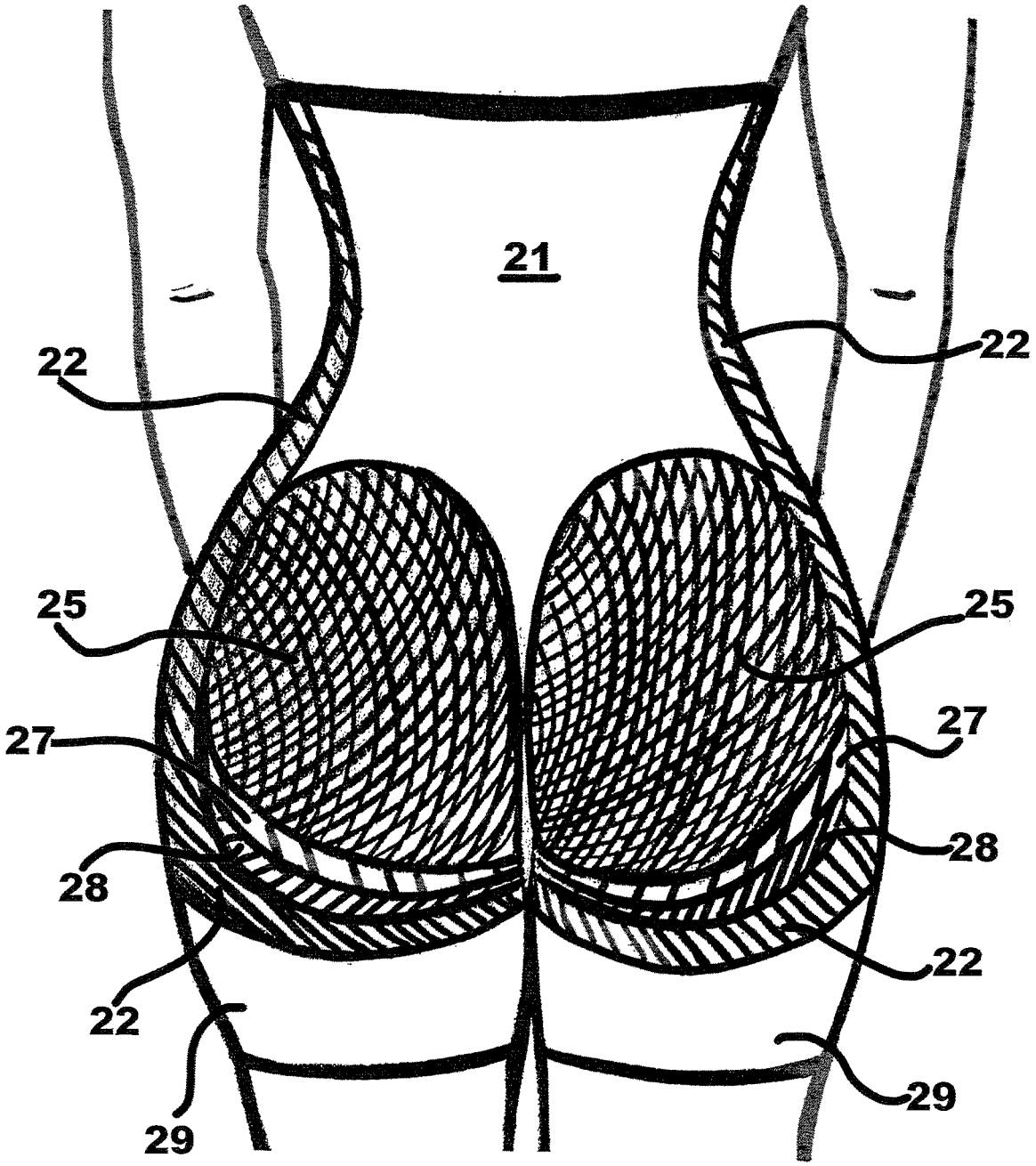
FIG. 7 is a rear perspective detail of the alternate embodiment mesh covering as in FIG. 6 showing the two higher density bands near the bottom of the mesh areas of both buttocks.
Figure 8:
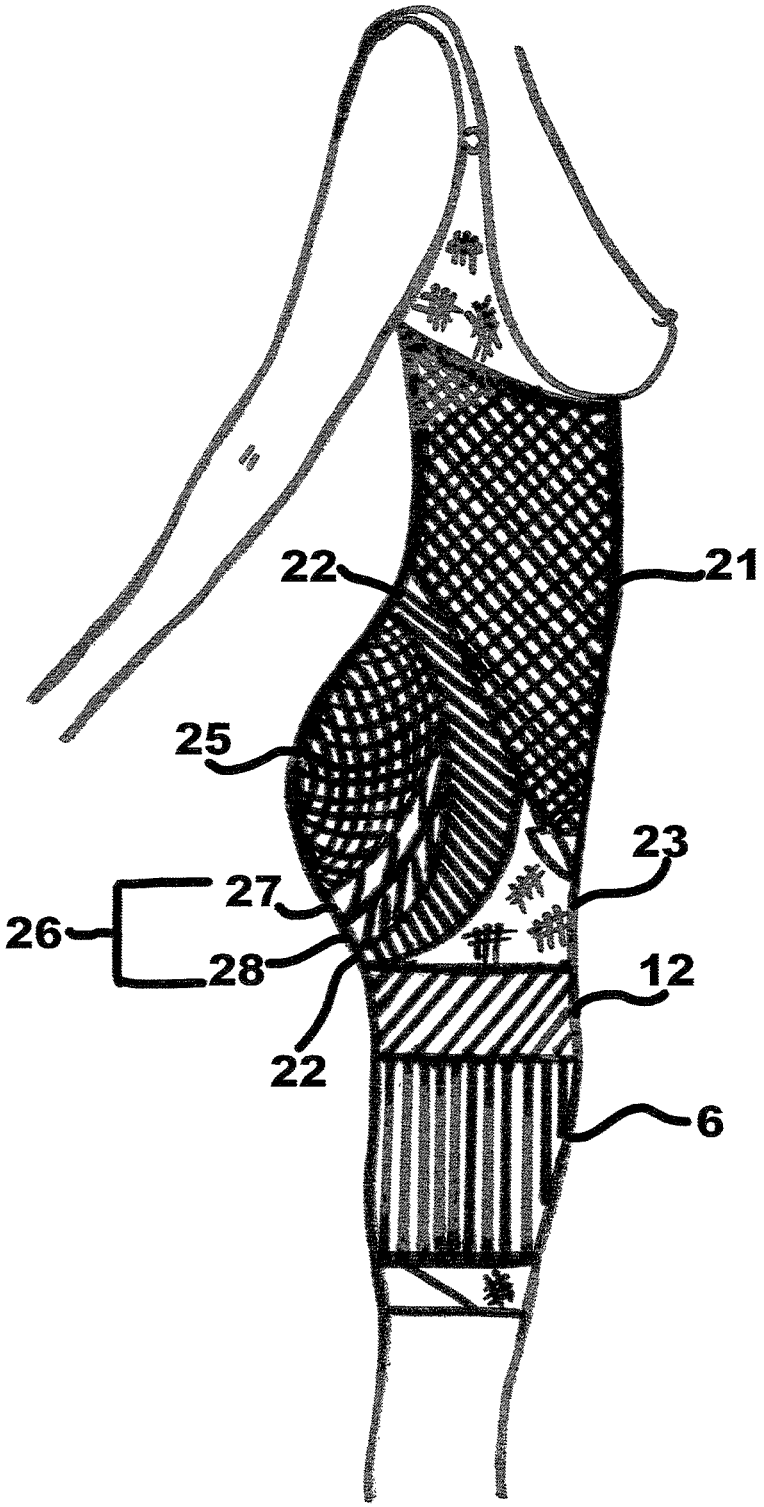
FIG. 8 is a left-side perspective view of the body shaper undergarment of the present invention, showing the higher density bands of both buttocks as well as the higher density mesh bands near the bottom of the front mesh region.

FIGS. 6, 7 and 8 illustrate an alternate embodiment with torso region 21 below the breasts wherein the expandable mesh areas 24 for the buttocks have variable stretchability.

FIG. 6 is a side detail view of a right buttocks area covered in expandable mesh 24 that has a plurality of sub-regions, preferably three sub-regions of stretch 25, 27 and 28. While most of the expandable buttocks covering area 25 is thin and quite stretchable; the bottom sub-region 26 has two crescent shaped bands' sub-regions 27 and 28 which become more dense and have less stretch. Band 28, adjacent to support fabric 22 is the densest mesh while band 27 is less dense than band 28 but denser than the upper buttocks covering area 25. Upper thigh support rings 12 is denser than the lower thigh support rings 6 as also shown.

FIG. 7 shows the same details from a back view of both buttocks covering areas 25, which is supported by denser mesh sub-region band 27 and densest mesh sub-region band 28 below. However, the main support for the main mesh buttocks covering area 25 and intermediate set 26 of denser mesh sub-regions' bands 27 and 28 is from the densest flank supports 22, which extend from the sides of the body shaper undergarment and around the outer sides of the buttocks covering areas 25 and 26 and bottoms thereof. Below the bottom portion of flank supports 22 are located thigh rings 29.

FIG. 8 illustrates the body shaper undergarment of the second embodiment with three sub-regions 25, 27 28 of stretch for both the buttocks mesh as well as the front mesh. In this side view, both rear mesh 25 as well as torso region 21 can be seen. The expandable mesh buttocks regions 24 and supported on the sides and bottom. Less supportive thigh rings 29 are also shown. It is important that seamless implementation of these sub-region bands is used to eliminate outwardly visible lines. A continuously variable stretch knitting is ideally suited to replace the discrete bands shown here.

FIGS. 9 to 12 presented here represents body shaper undergarments which are constructed of breathable sweat-wicking material using seamless WKS or similar knitting techniques with compression in the abdominal area.

Figure 9:
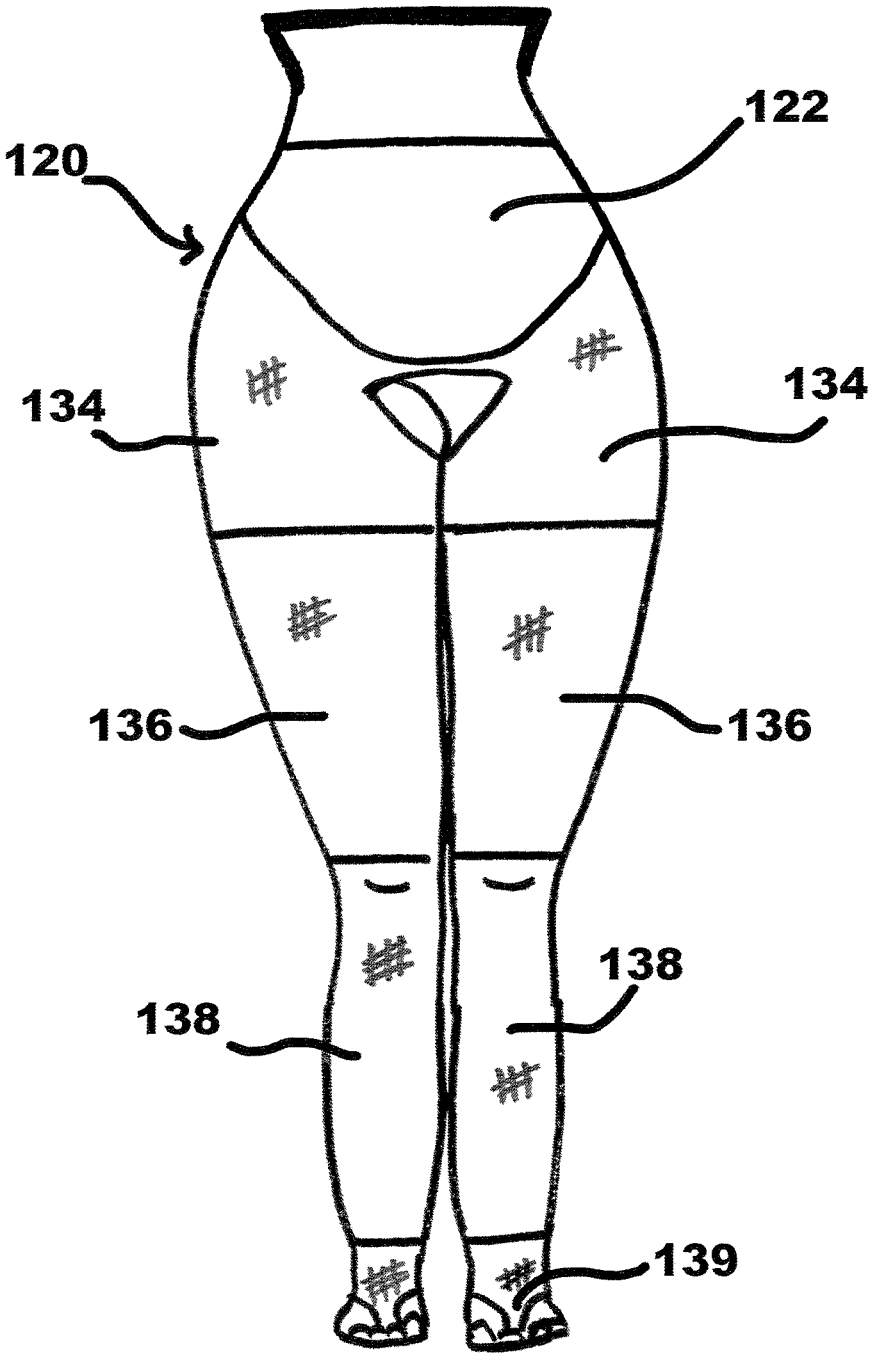
FIG. 9 is also a front elevation view of the body shaper undergarment of FIG. 3, showing various leg covering lengths thereon.
Figure 10:
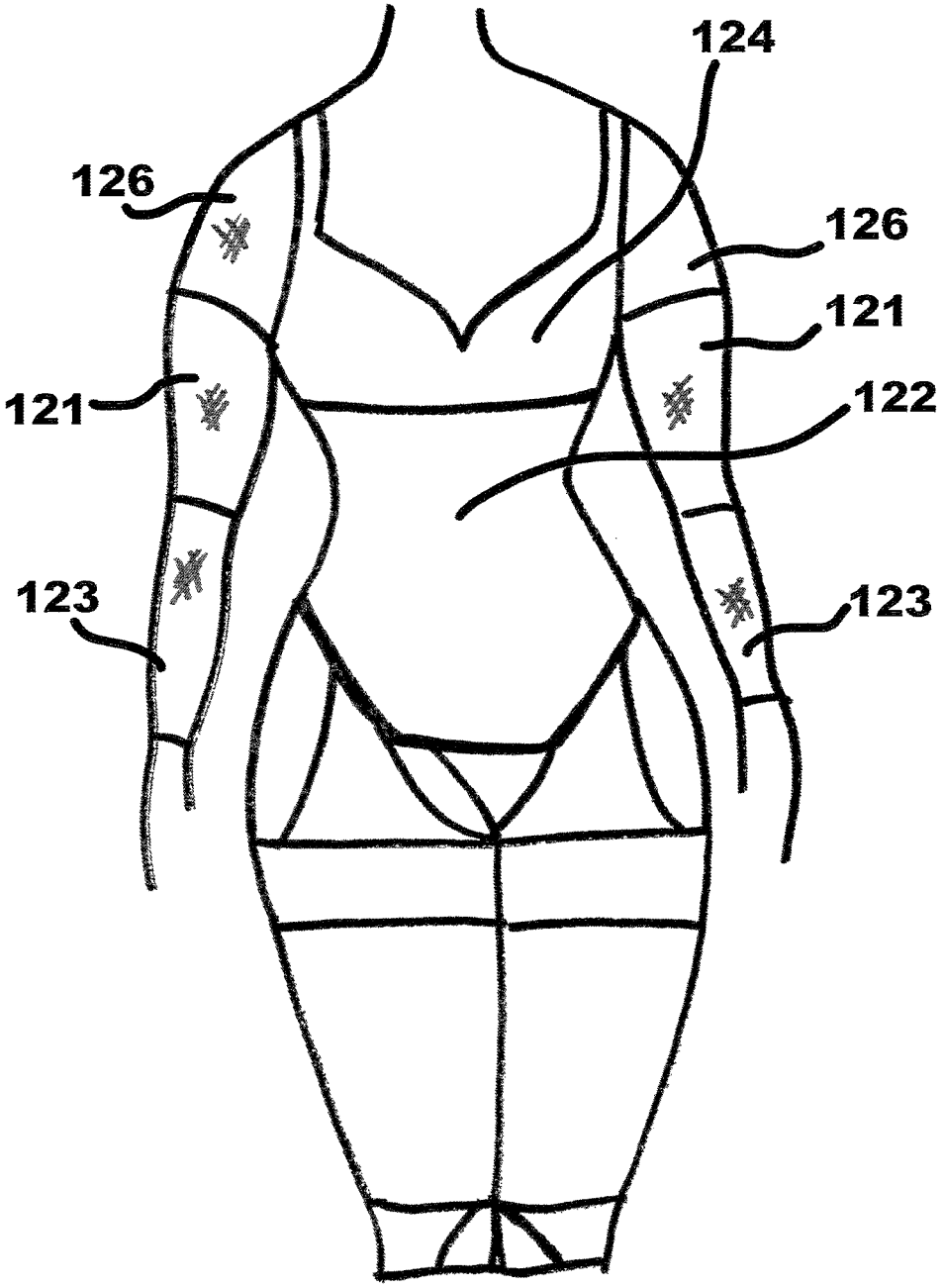
FIG. 10 is a front elevation of the body shaper undergarment of FIG. 3, showing various sleeve covering lengths thereon.

FIGS. 9-10 illustrate garment 120 with central abdominal region 122 and lower hip region 134. It can be paired with bottom covering shorts, pants or skirt for use as active wear. In FIGS. 9 and 10, garment 120 has a top breast region 124 and central abdominal region 122 (below the breasts). It has snaps in the crotch area (not shown). Also shown as short sleeves 126, half sleeve 121 and full sleeve 123 extents which are indicated, as are thigh length regions 136 or lower leg portions 138, and hip portions 134. If bright color pattern is used, the outer layer of control abdominal region 122 is 84% polyester and 16% LYCRA® or elastane, because this holds color and patterns better than a 90% nylon and 10% LYCRA®, or elastane. The fabric mix can also be of nylon and elastane, an elastic polyurethane material in an 84% to 16% ratio, with a thickness of between about 150 to 400 GSM .A single layer fabric back region (not shown) may be provided below the compression zone and adjacent to the crotch. The abdominal compression area 122 may optionally include a plurality of two or more areas, preferably three layers, including an inner skin contact compressive breathable layer capable of emitting body sweat therethrough, a stronger middle compressive layer and an outer breathable compressive layer.

Figure 11:
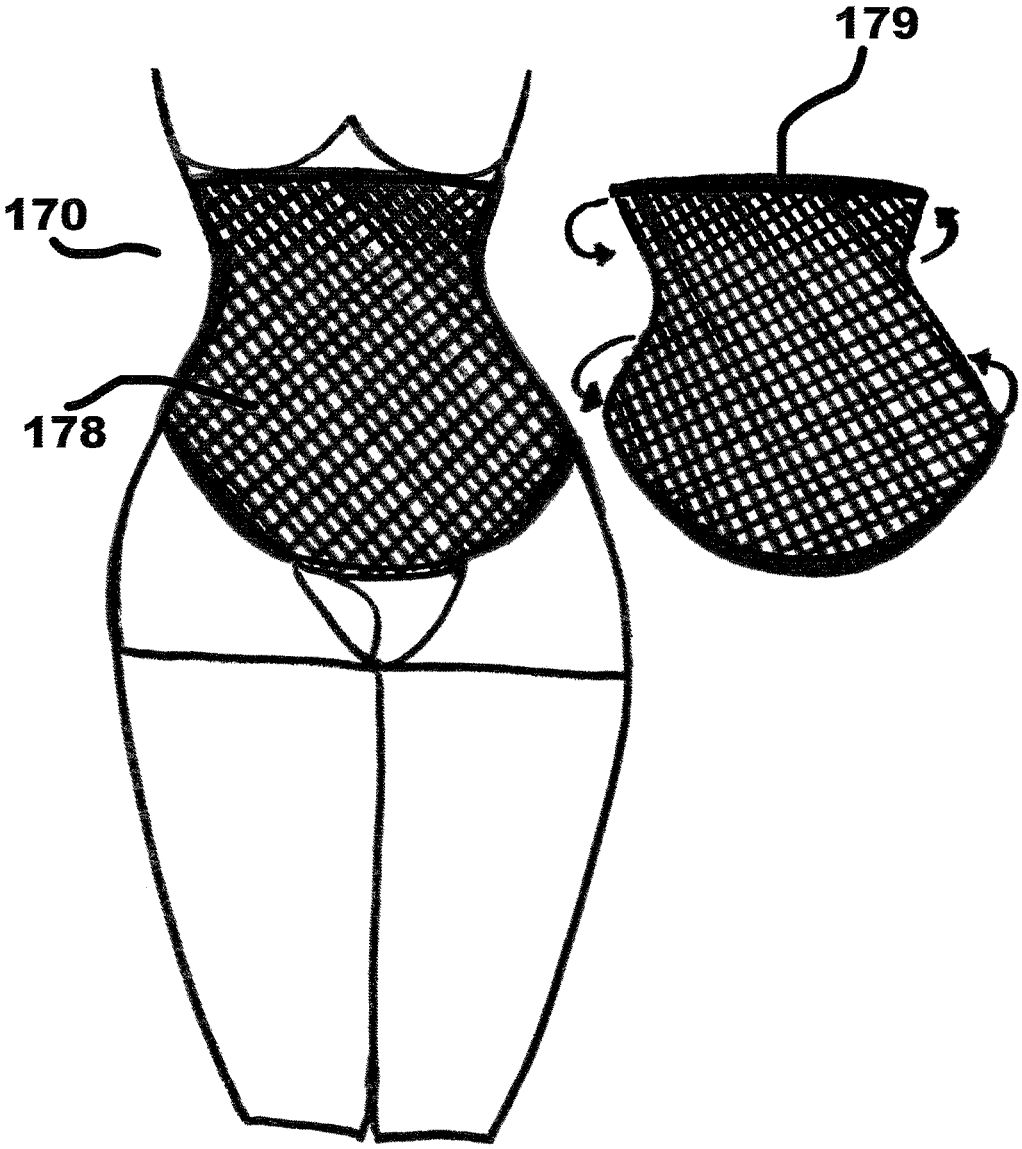
FIG. 11 is a front elevation of a woman's body shaper undergarment showing an exploded view of a compressive sweat porous second layer for the abdominal portion, extending below the breasts down to cover the pelvic area of the wearer, where the arrows indicate the layer can be on the front, sides and/or rear of the body shaper undergarment.
Figure 12:
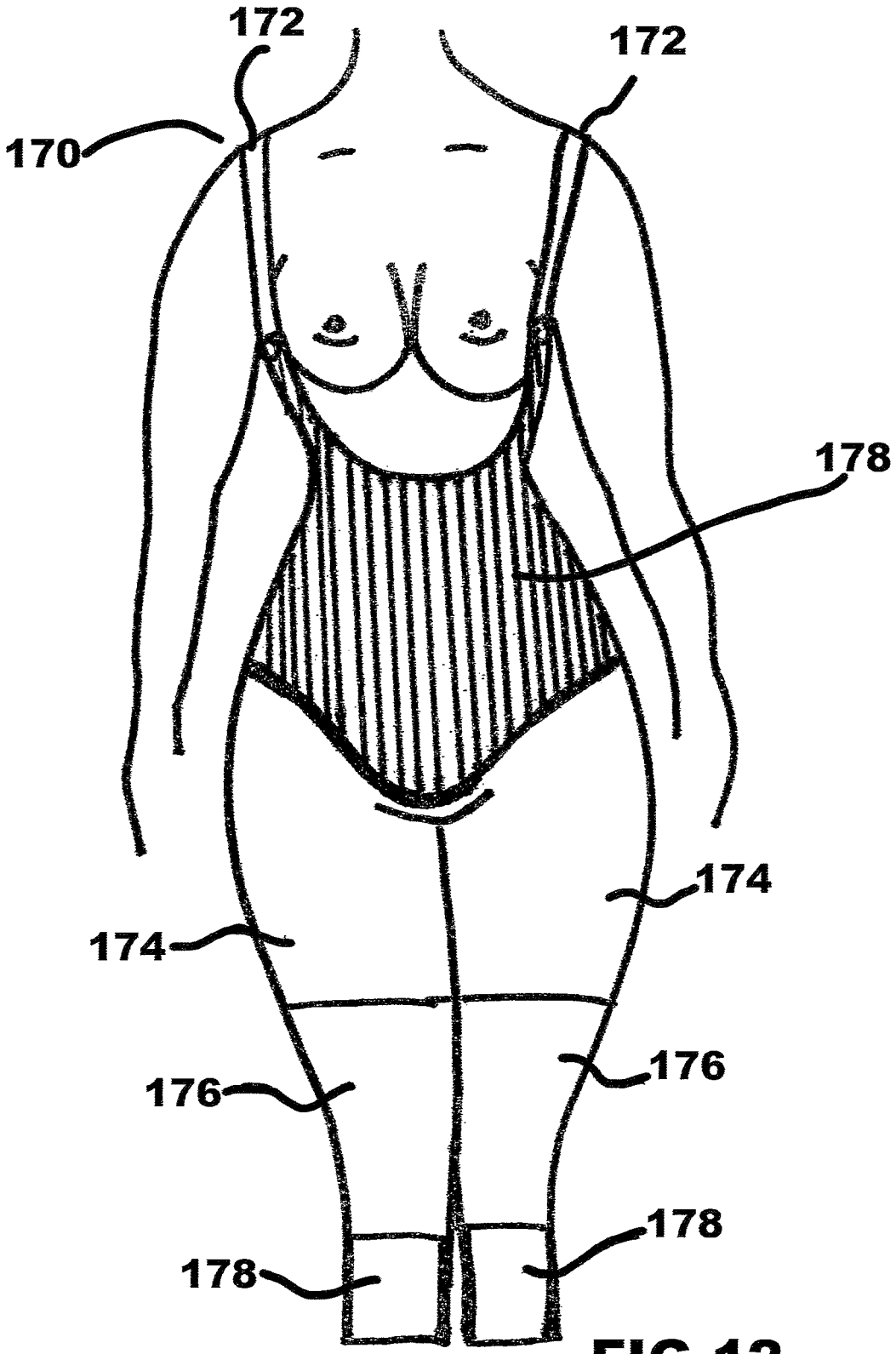
FIG. 12 is a front elevation of the women's body shaper undergarment of FIG. 11, showing the breasts revealed for covering with an outer garment blouse or shirt.

FIGS. 11 and 12 show body shaper undergarment 170 with central abdominal area 178, shown exploded with the arrows of area 178 indicating a second layer 179, which may cover the front, sides and/or back of garment 170. One-piece integral layer 179 extends over the full abdominal area, from immediately below the breasts down to cover the pelvic area of the wearer, extending laterally from side hip to side hip. FIG. 12 shows garment 170 as with the breast region removed, so that it can be comfortably covered by a looser blouse or other top.

Figure 13:
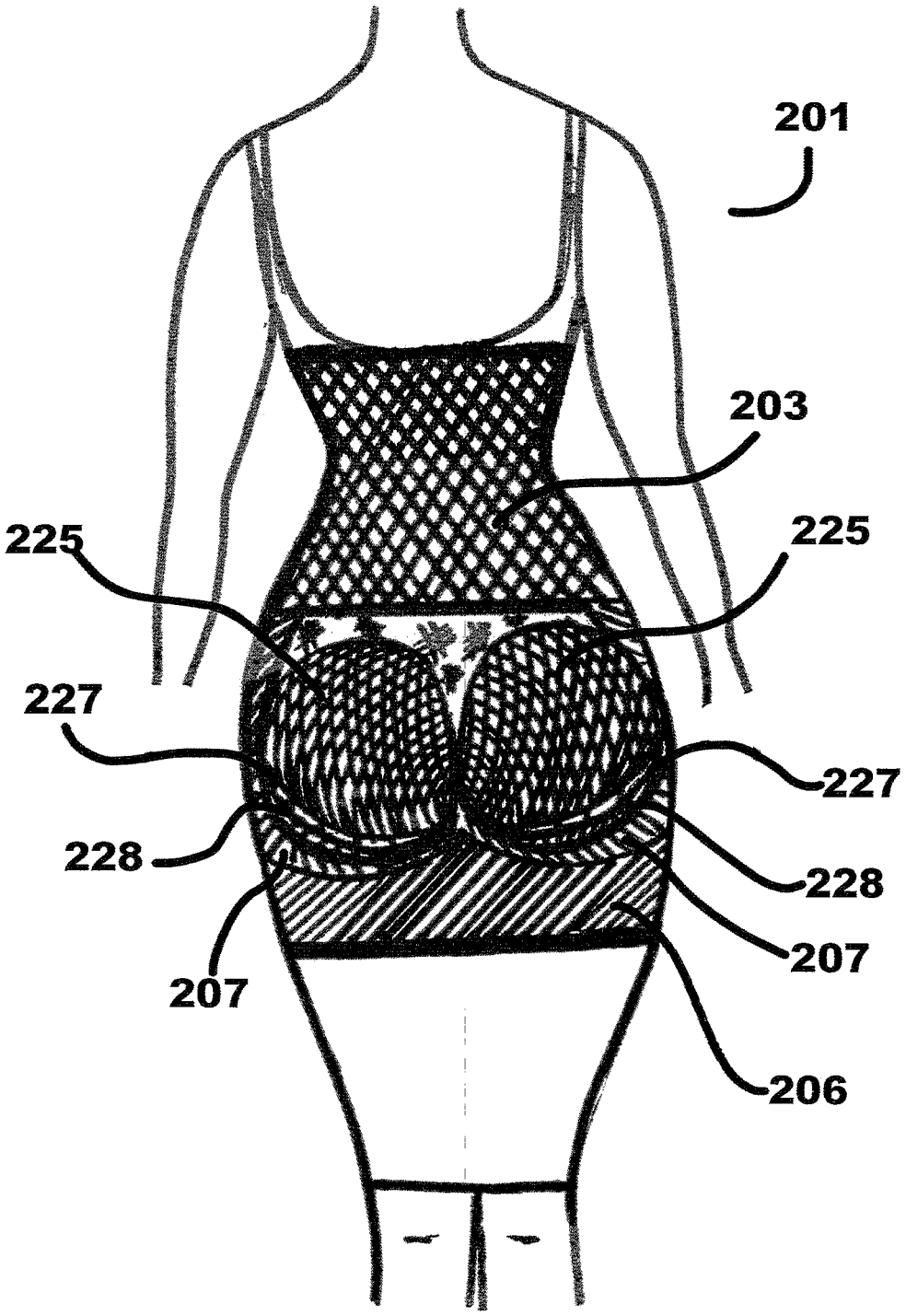
FIG. 13 is a rear view of another embodiment for a body shaper undergarment with flexible, expandable, reinforced lace mesh body parts, shown covering the buttocks of the wearer.

FIG. 13 shows an alternate preferred embodiment for a rear view of a woman's shapewear undergarment 201 with flexible, expandable, reinforced lace mesh body parts 202, shown covering the breasts of the wearer. The flexible, expandable lace mesh portions 202 are positioned above abdominal portion 203 and hip covering portions 206. Variable length leg portions for shorts 206, thigh length 208, knee height 210 and full-length 212 are also shown.

FIG. 13 also shows a rear view of body shaper undergarment 201 with flexible, reinforced lace mesh body parts 225, shown covering the buttocks of the wearer. Alternate lower buttocks support mesh portions 227 and 228 of increased mesh density are shown below lace mesh portions 225. Back torso portion 230 is shown with side and bottom flank portions 207 below buttocks portions 225.

Figure 14:
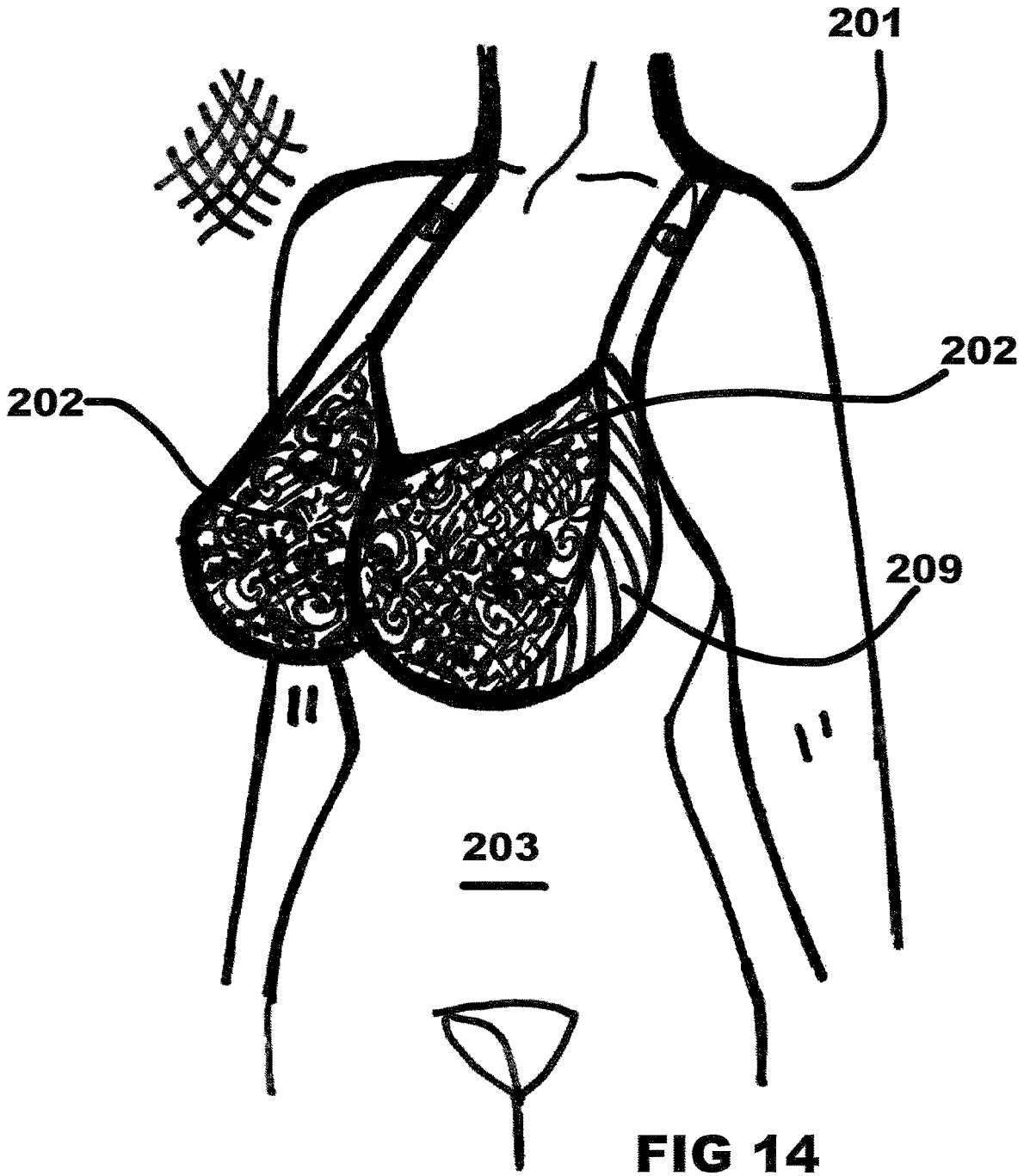
FIG. 14 is a front perspective view of the breast area of the preferred embodiment of FIG. 13 for a body shaper undergarment with flexible, expandable, reinforced lace mesh body parts, shown covering the breasts of the wearer.

FIG. 14 is a front perspective view of the top portion of the preferred body shaper undergarment embodiment of FIG. 13 for a shapewear garment 201, and shown with flexible, expandable reinforced lace-patterned mesh breast pockets 202, shown covering the breasts of the wearer above torso portion 203. To support the expandable lace mesh breast portions 202, side flank support portions 209 of greater density are provided, of the same material as flank support portions 207 supporting expandable lace mesh buttocks portions 207, as shown in FIG. 13.

Figure 15:
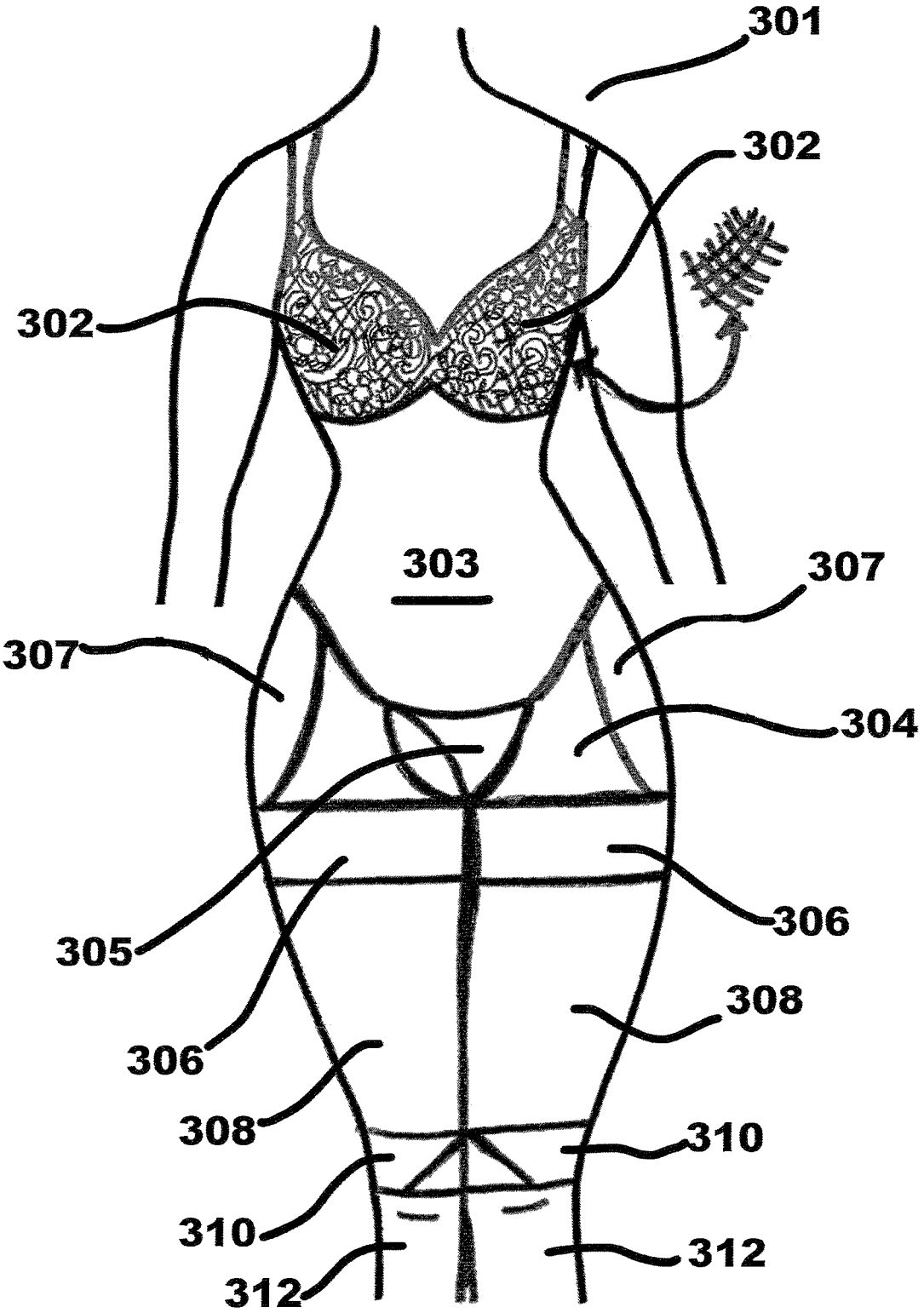
FIG. 15 is a front elevation view of an alternate preferred embodiment for shapewear garment with flexible, expandable, reinforced lace-patterned mesh body parts and multilayer abdominal compressive layers, wherein the expandable lace mesh body parts are shown covering the breasts of the wearer.
Figure 16:
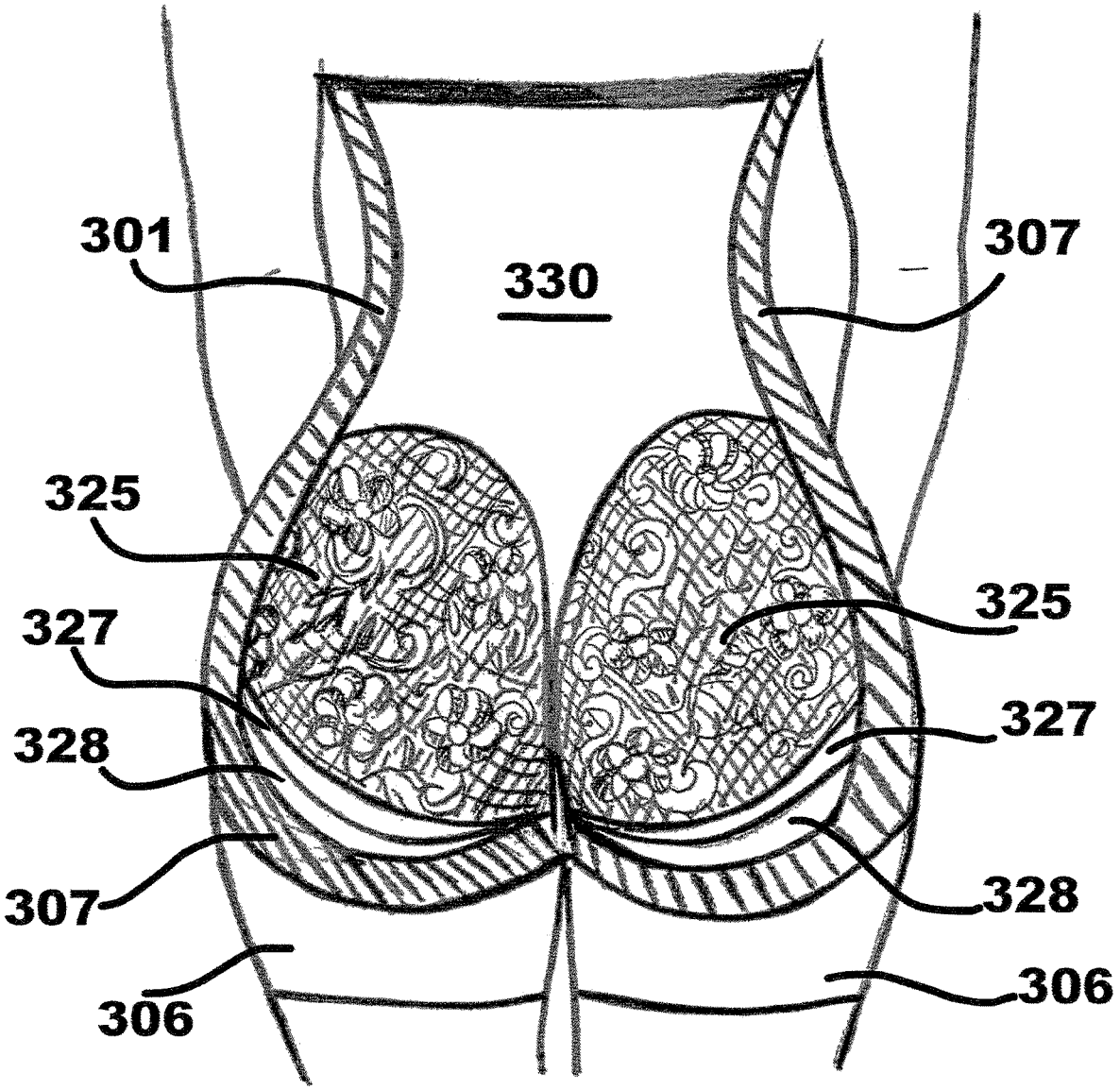
FIG. 16 is a rear view of an alternate preferred embodiment shown in FIG. 15 for shapewear garment with flexible, expandable, reinforced lace-patterned mesh body parts and multilayer abdominal compressive layers, wherein the expandable lace-patterned mesh body parts are shown covering the buttocks of the wearer.
Figure 17:
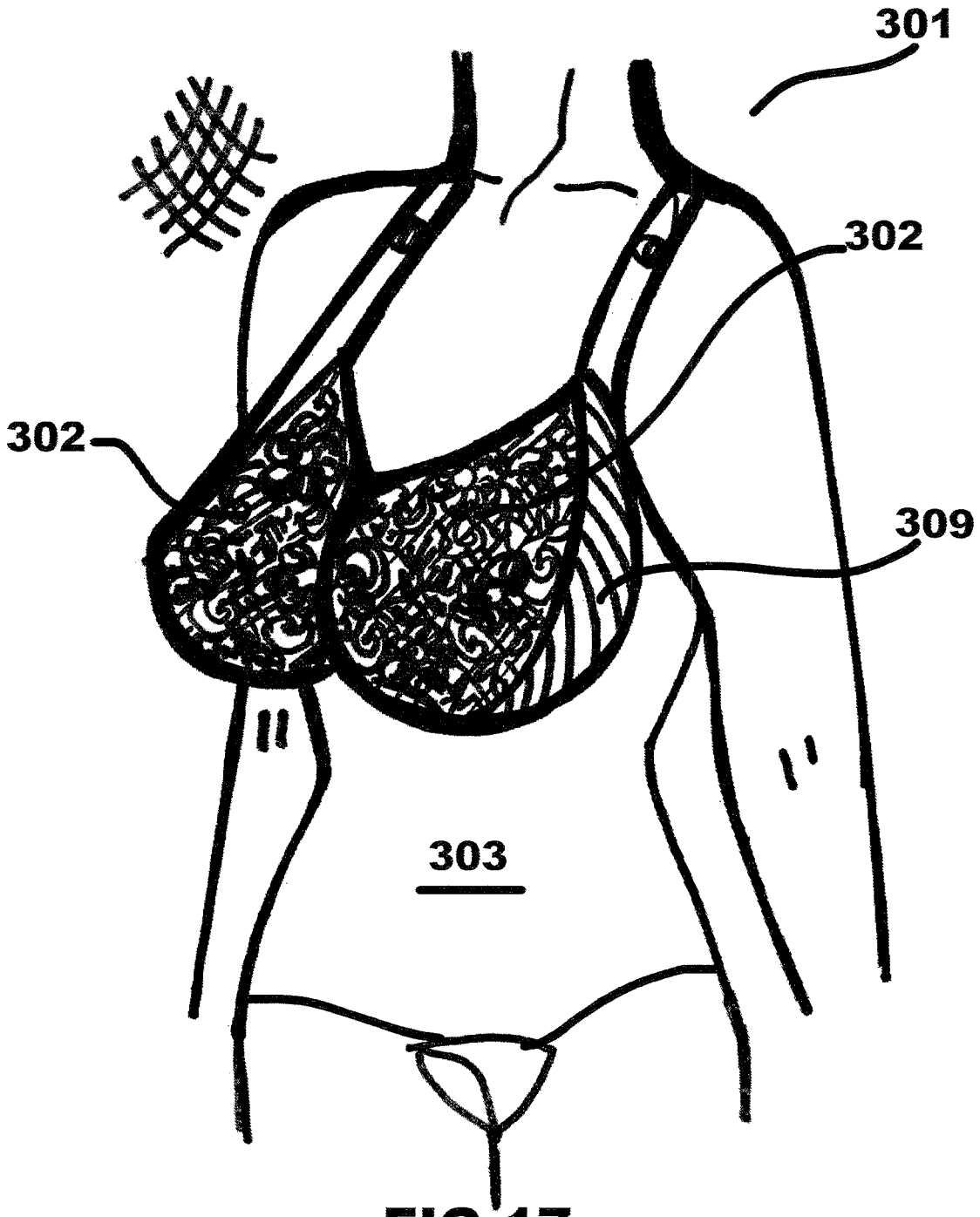
FIG. 17 is a front perspective view of the breast area of the alternate preferred embodiment shown in FIG. 15 for shapewear garment with flexible, reinforced, expandable, lace-patterned mesh body parts and multilayer abdominal compressive layers, wherein the expandable, lace-patterned mesh body parts are shown covering the breasts of the wearer.

FIGS. 15, 16 and 17 show an alternate preferred embodiment for shapewear garment 301 with abdominal support region 303 with flexible, expandable reinforced lace-patterned mesh body pockets 302 for breasts and reinforced, expandable lace-patterned mesh body portions 325 for the buttocks and multilayer abdominal compressive layers in abdominal support region 303, wherein the lace-patterned mesh body parts 302 are shown covering the breasts of the wearer.

Also shown in FIG. 15 below abdominal support region 303 are hip portions 304 and gusset 305 for bathroom use. Variable leg portions are shown, including shorts length 306, thigh length 308, knee height length 310 and full leg portions 312.

FIG. 16 also shows the lace mesh body parts 325 are shown covering the buttocks of the wearer, wherein optional varying density crescent mesh sub-portions 327 and 328 are shown below less dense mesh buttocks sub-portions 325, which are supported by side and bottom flank portions 307, above optional leg portions 306.

FIG. 17 is a front perspective view of the top portion of the preferred body shaper undergarment embodiment of FIG. 15 for a shapewear garment 201, and shown with flexible, expandable reinforced lace-patterned mesh breast pockets 302, shown covering the breasts of the wearer above torso portion 303. To support the expandable lace mesh breast portions 302, side flank support portions 309 of greater density are provided, of the same material as flank support portions 307 supporting lace mesh buttocks portions 307, as shown in FIG. 16.

Figure 18:
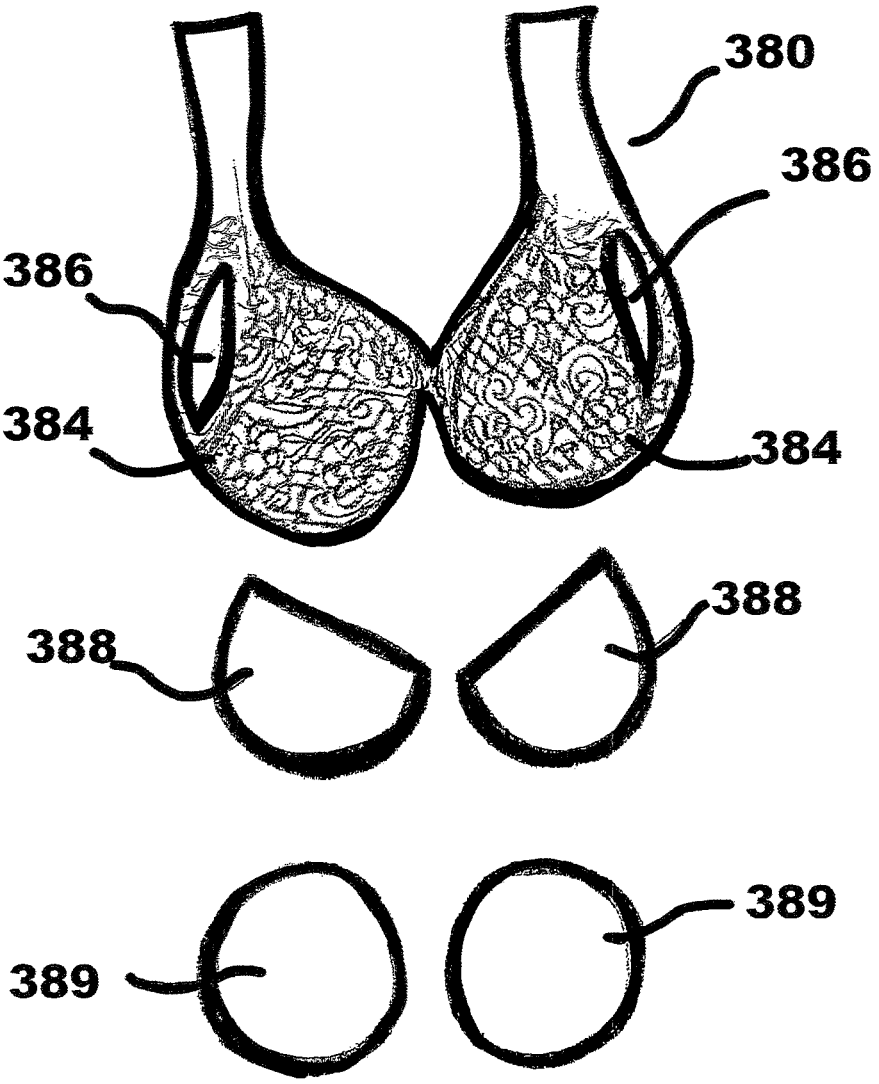
FIG. 18 is an exploded detail view of a brassiere with expandable, lace-patterned breast pockets, to be used with a woman's garments, shown with slots for insertion of silicone or other synthetic breast inserts.

FIG. 18 is an exploded detail view of a brassiere 380 with lace-patterned breast pockets 384 to be used with the aforementioned woman's garments, with slots 386 for insertion of silicone or other synthetic breast inserts 388 or 389 therein.

Figure 19:
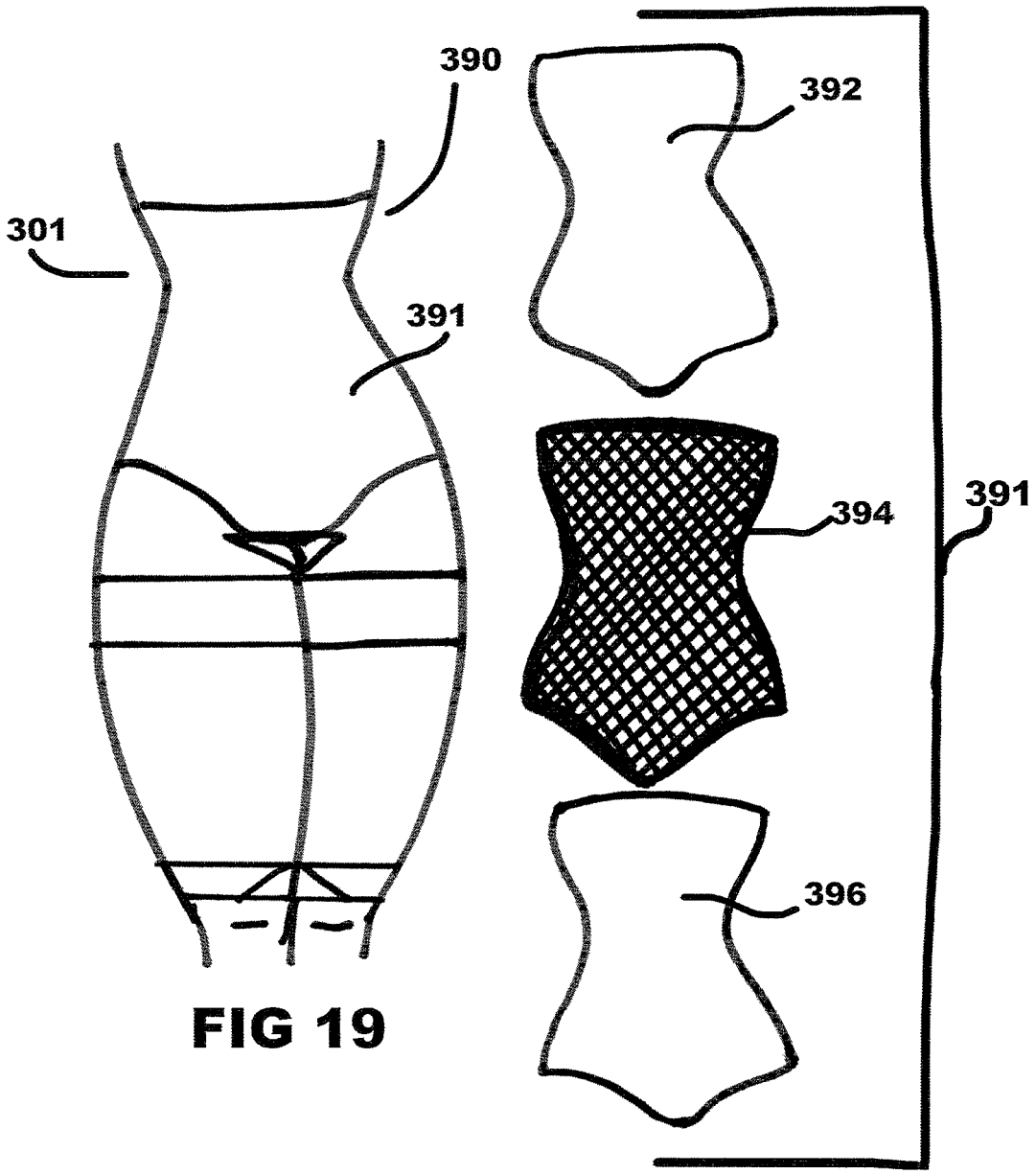
FIG. 19 is an exploded detail view of the torso portion of a woman's garment, shown with a first outer compressive layer, a stronger middle compressive layer and an inside compressive layer to be placed adjacent to the wearer's skin, where each of the layers extends from below the breasts down to cover the pelvic area of the wearer.

FIG. 19 is an exploded detail view of the torso portion 390 of a woman's garment 301, shown with a first outer compressive sweat porous layer 392, a mid-stronger compressive layer 394 extending over the full abdominal area from immediately below the breasts down to cover the pelvic area of the wearer, extending laterally from side hip to side hip, and an inside compressive sweat porous layer 396 to be placed adjacent to the wearer's skin.

Figure 20:
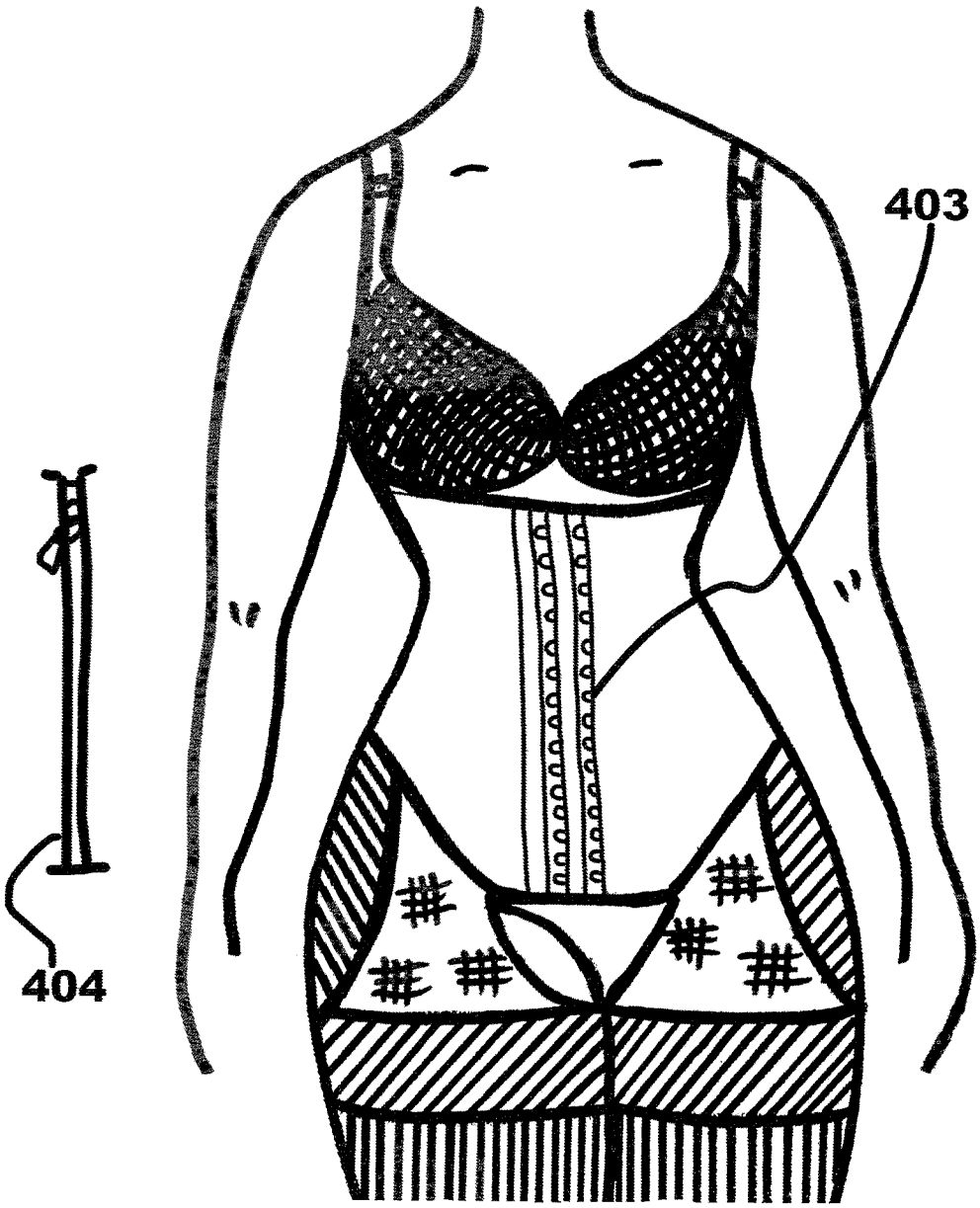
FIG. 20 in a front perspective view of a body shaper undergarment with a corset for covering the abdominal portion of the body shaper garment.

FIG. 20 shows the body shaper undergarment as a corset for covering the abdominal portion of the body shaper, where the corset of FIG. 20 is shown as another uniform fabric layer that goes all around the mid-body (front, sides and back.)

The section where the attachment hooks or zipper connects is made of a strong fabric that can hold the stretching on the waist area. The hook and eye are made of metal or strong plastic, because they need to be strong.

Reference numeral 403 is the front closer with eye and hook style of the abdominal tummy area and reference numeral 404 is for the zipper closer shown as an option on the side. The reason the garment may be in corset style, too, is because for after plastic surgery, such as tummy tuck or liposuction, the waist and tummy area as time passes, the torso, tummy and waist area get smaller and smaller because of the post-surgical swelling.

After liposuction, major swelling may last for a month or two. The minor swelling can linger for several months after that. The skin contraction and shrinkage takes approximately 6-9 months to occur and the body shaper is to be worn for the first 4-6 weeks to assist in the skin contraction such that an even contour is achieved and that is the reason the eye and hook style corset closer is good, because the wearer can make it smaller as they lose inches on their waist area.

The corset front closer hook and eye clips of the corset can be sewn or glued to a front panel like a regular corset with the eye and the or a zipper.

In preferred embodiments, the woman's undergarments shown in drawing FIGS. 3-20 are seamless, without any stitching or gluing of the various parts of the garment separately. However, in non-preferred embodiments the various parts of the woman's undergarments can be optionally separately made and attached together to a central hollow body portion by being sewn with threads or glued with strips of glue or other adhesive.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A woman's body shaper under garment undergarment comprising:

a compressible abdominal torso region;

a pair of expandable, stretchable buttocks-covering mesh regions having side flank areas of fabric configured to provide side support for said expandable, stretchable mesh buttocks-covering mesh regions, said flank areas extending on sides and bottoms of said buttocks-covering mesh regions;

wherein said expandable, stretchable buttocks-covering mesh regions include multiple regions of expansion and stretch, with lower portions of said multiple regions being less expandable and stretchable than intermediate regions of expansion and stretch;

wherein said pair of expandable, stretchable buttocks-covering mesh regions include first, second and third mesh regions provided in thicknesses or densities in deniers in a range of about 10 deniers to about 100 deniers; and wherein the first mesh region is provided in a thickness of a range of deniers of from about 81 deniers to about 100 deniers, wherein further the second mesh region is provided in a thickness or density in deniers of from about 51 deniers to about 80 deniers, wherein the second mesh region is less dense and lighter than said first mesh region and wherein the third mesh region is provided in a range of about 10 deniers to about 50 deniers, wherein the third mesh region is the least dense and lightest of the first, second and third mesh regions.

2. The woman's body shaper undergarment of claim 1 wherein said undergarment is seamless.

3. The woman's body shaper undergarment of claim 2 wherein said undergarment is constructed entirely of knitted materials, and wherein said undergarment is manufactured in one continuous knitting process, thereby eliminating a post-process of attaching elastic bands to said undergarment.

4. The woman's body shaper undergarment of claim 3 wherein said undergarment has an opening for use of a bra extending therethrough.

5. The woman's body shaper undergarment of claim 1 further comprising arm and leg portions.

6. The woman's body shaper undergarment as in claim 5 wherein said arm portions are made of fabric having a linear density of from about 30 to about 200 deniers.

7. The woman's body shaper undergarment as in claim 1 further comprising wearable copper threaded fabric.

8. The woman's body shaper undergarment as in claim 7 wherein said wearable copper threaded fabric is mixed with flexible fabrics selected from the group consisting of elastane, nylon and spandex, wherein further said wearable copper fabrics are knitted or woven with non-conductive yams.

* * * * *